US005486108A

United States Patent [19]

Kubota

[11] Patent Number: 5,486,108

[45] Date of Patent: Jan. 23, 1996

[54] GAS BURNER

[75] Inventor: Norikazu Kubota, Gunma, Japan

[73] Assignee: Sanyo Electric Co., Ltd., Moriguchi, Japan

[21] Appl. No.: 972,706

[22] Filed: Nov. 6, 1992

Related U.S. Application Data

[63] Continuation of Ser. No. 880,129, May 7, 1992, abandoned.

[30] Foreign Application Priority Data

| | | | |
|---|---|---|---|
| May 7, 1991 | [JP] | Japan | 3-101514 |
| May 27, 1991 | [JP] | Japan | 3-121123 |
| Jun. 27, 1991 | [JP] | Japan | 3-157156 |
| Oct. 22, 1991 | [JP] | Japan | 3-301229 |
| Nov. 20, 1991 | [JP] | Japan | 3-304751 |

[51] Int. Cl.[6] ..... F23D 14/46

[52] U.S. Cl. ..... 431/181; 431/8; 431/350

[58] Field of Search ..... 431/8, 9, 349, 431/350, 115, 116, 181, 182, 183, 184, 185, 186, 187, 188, 159, 353

[56] References Cited

U.S. PATENT DOCUMENTS

| | | | |
|---|---|---|---|
| 3,349,826 | 10/1967 | Poole et al. | 431/186 X |
| 3,586,241 | 6/1971 | Brownsburg | 431/183 X |
| 3,586,242 | 6/1971 | Brownsburg | 431/183 X |
| 4,050,879 | 9/1977 | Takahashi et al. | 431/186 X |

FOREIGN PATENT DOCUMENTS

| | | | |
|---|---|---|---|
| 0462695 | 12/1991 | European Pat. Off. . | |
| 0006132 | 1/1977 | Japan | 431/349 |
| 1565198 | 4/1980 | United Kingdom . | |

*Primary Examiner*—Carl D. Price
*Attorney, Agent, or Firm*—Darby & Darby

[57] ABSTRACT

An improved gas burner comprising a gas nozzle having a first flame stabilizer mounted to the front end thereof and a plurality of gas blow apertures arranged circumferentially therein adjacent to the first flame stabilizer, a second flame stabilizer having a plurality of secondary combustion air passages arranged in the circumferential end thereof and a primary combustion air passage arranged in the center thereof which is defined by the outer surface of the gas nozzle, and a burner cone accommodating the second flame stabilizer coupled to the inner wall thereof, said gas burner being improved for reducing unwanted nitrogen oxide and/or uncombusted gas, characterized in the positional relation between the flame stabilizer(s) and the gas blow apertures, the novel construction in which the shape of the flame stabilizer is designed for optimum function with association with its positional relation, the novel arrangement in which the flame stabilizer can be controlled for optimum positioning, and the improved burner head arrangement for producing a ring of separate combustion flames.

14 Claims, 15 Drawing Sheets

GAS BURNER

This is a continuation, of application Ser. No. 07/880, 129, filed May 7, 1992 abandoned.

BACKGROUND OF THE INVENTION

1. Field of the Invention

The present invention relates to a gas burner for use with an absorption chiller, absorption chiller heater, absorption heat pump, or boiler.

2. Background Art

It has been attempted to reduce a subproduct of nitrogen oxide (referred to as NOx hereinafter) discharged from e.g. a boiler facilitated in an industrial plant or building structure. In particular, the reduction of NOx in a gas burner of the boiler is much concerned.

One of such low NOx gas burners developed by us and submitted previously for patent application is disclosed as shown in FIGS. 1 and 2, which comprises a gas nozzle 31 having a first flame stabilizer 34 mounted to the front end thereof, a second flame stabilizer 33 having e plurality of secondary combustion air passages 30 arranged in the circumferential edge thereof and a primary combustion air passage 36 provided in the center thereof which is defined by the outer surface of the gas nozzle 31, and a burner cone 32 accommodating the second flame stabilizer 33 coupled to the inner wall thereof. In action, radial flows of a fuel gas are blown outward from their respective gas blow apertures 35 so that they come not crossing the secondary combustion air passages 30. Accordingly, the reduction of NOx will be achieved.

When such a conventional gas burner is installed in e.g. a small sized furnace, its fuel gas from the gas blow aperture is dispersed without proper mixture with the secondary combustion air from the secondary air passages. Hence, the resultant combustion flames expand largely up to the inner wall of the furnace thus producing an uncombusted gas, e.g. CO gas.

Further, when it is installed in a large sized furnace having an extensive combustion chamber, its combustion flames become unstable due to combustion pulsation and will produce oscillating combustion.

Furthermore, when it is installed in a recombustion type furnace, its combustion flames hardly reach the innermost of the furnace causing short pass. As the result, the combustion will be declined in efficiency and produce a considerable amount of uncombusted gas, e.g. CO gas.

SUMMARY OF THE INVENTION

A primary object of the present invention is to provide an improved gas burner containing means for solving the foregoing problems and arranged for use with a variety of furnaces without changing the substantial construction and arrangement of a traditional low NOx gas burner.

More particularly, four novel means are provided, as denoted below, for use solely or in combination for attenuating the generation of NOx. As the result, a gas burner according to the present invention becomes capable of controlling the size and strength of combustion flames and appropriate for use with a variety of furnaces and will thus produce a less amount of unwanted NOx.

1. Positional relation between the flame stabilizer(s) and the gas blow apertures.

2. Novel construction in which the shape of the flame stabilizer is designed for optimum function with association with its positional relation depicted in the above clause 1.

3. Novel arrangement in which the flame stabilizer can be controlled for optimum positioning.

4. Improved burner head arrangement for producing a ring of separate combustion flames.

[Action 1]

In order to solve the foregoing problems, a gas burner according to the present invention comprises a gas nozzle 4 having a first flame stabilizer 7 mounted to the front end thereof and a plurality of gas blow apertures 8 provided circumferentially therein adjacent to the first flame stabilizer 7, a second flame stabilizer 10 having a plurality of secondary combustion air passages 11B arranged at equal intervals in the circumferential end thereof and a primary combustion air passage 11A arranged in the center thereof which is defined by the outer surface of the gas nozzle 4, and a burner cone 5 accommodating the second flame stabilizer 10 coupled to the inner wall thereof, in which the distance x between the first and second flame stabilizers 7,10 is expressed as:

$$y \leqq x \leqq 5y$$

where y is the diameter of the gas blow aperture 8, and the outer diameter of the first flame stabilizer 7 is greater than the inner diameter of the second flame stabilizer 10. Hence, the combustion temperature will be lowered and the generation of NOx will thus be minimized.

Also, the second flame stabilizer 10 is disposed adjacent to the gas blow apertures 8 and arranged to have a multiplicity of extra air supply apertures 12 for stimulating the mixture of a fuel gas with second combustion air. Accordingly, the combustion is encouraged and the generation of uncombusted gas and/or NOx will be attenuated.

During combustion action, the fuel gas from the gas blow apertures 8 is mixed with the primary combustion air from the primary combustion air passage 11A and flows radially of the second flame stabilizer 10 between the first and second flame stabilizers 7,10. As the result, the combustion flames are widely expanded and its temperature will be reduced by the cooling effect of flame dispersion. Hence, the generation of NOx will be minimized.

[Action 2]

In action, the fuel/air mixture gas is mixed with the second combustion air from extra air supply apertures 12 for perfectly combustion. The air supply apertures 12 are provided adjacent to the gas blow apertures 8 so that dispersion and separation of combustion flames can remain unaffected by the secondary combustion air from the air supply apertures 12. Accordingly, the generation of NOx will be minimized.

As shown in FIG. 4, each group of the air supply apertures 12 of the second flame stabilizer 10 is aligned radially of the gas nozzle with its corresponding gas blow aperture 8. The air supply aperture group 12 consists of two rows between which a flow of the fuel gas from the gas blow aperture 8 runs radially. The amount of the secondary combustion air fed from the air supply apertures 12 of the second flame stabilizer 10 is adjusted to 3% to 10% of the total secondary combustion air supply which passes through the secondary air passages 11B and the air supply apertures 12. In action, the fuel gas from the gas blow apertures 8 is mixed with the primary combustion air from the primary combustion air passage 11A to a mixture gas which runs radially. Hence, the mixture gas flows at approximately a right angle to the flow of the secondary combustion air from the air supply apertures 12 of the second flame stabilizer 10. Each flow of the fuel gas from the gas blow aperture 8 becomes turbulent due to the secondary combustion air flow of the air supply aperture group 12. This action accelerates the mixture of fuel gas from the gas blow apertures 8 with combustion air particularly when the fuel gas is less in supply and low in velocity. As the fuel/air mixture gas runs radially of the second flame stabilizer 10, it is further mixed with the second combustion air fed from the air supply apertures 12.

As understood, the mixture gas flows at approximately a right angle to the flow of the second combustion air from the air supply apertures 12 and thus, their mixture will be stimulated to optimum combustion. Even if the supply of the fuel gas is less and its velocity is low, its combustion will be encouraged. As the result, the range of stable combustion is increased from high to low and the combustion action in the gas burner can be controlled through a wider range.

Also, the secondary combustion air from the air supply apertures 12 is determined to 3% to 10% of the total supply of the secondary combustion air for optimum mixture of the fuel gas and the combustion air. The air supply apertures 12 are arranged adjacent to the gas blow apertures 8 so that the dispersion and separation of the combustion flames are ensured. Hence, the mixing procedure will be stimulated without disturbing the effect of limiting the generation of NOx. The gas burner is thus capable of controlling the combustion through a wider range and minimizing the generation of NOx and improved in the utilization.

[Action 3]

Each of the gas blow apertures 8 is aligned radially of the gas nozzle with its corresponding secondary combustion air passage 11C of the second flame stabilizer 10, as shown in FIG. 9. Also, extra secondary combustion air passages 11D are arranged alternate with the secondary combustion air combustion passages 11C. In action, the generation of NOx will be minimized.

More particularly, the mixture gas of the primary combustion air and the fuel gas from the gas blow apertures 8 is mixed with the secondary combustion air from the secondary combustion air passages 11C which are arranged to match the gas blow apertures 8, thus producing a ring of rich combustion flames. Simultaneously, the secondary air from the secondary combustion air passages lid arranged not to match the gas blow apertures 8 is fed producing a ring of lean combustion flames. Accordingly, the combination of lean and rich combustion flames maintains the combustion temperature low and the generation of NOx will thus be attenuated.

[Action 4]

The first flame stabilizer 7 is arranged in front of the burner cone 5 and spaced by a greater distance from the second flame stabilizer 10 and also, the gas blow apertures 8 of the gas nozzle 4 are located adjacent to the first flame stabilizer 7, as shown in FIG. 10, so that the generation of NOx can be attenuated and the generation of uncombusted gas can be minimized.

In more particular, the fuel gas from the gas apertures 8 arranged adjacent to the first flame stabilizer 7 runs radially of the first flame stabilizer 7 as accompanied with the primary combustion air and will be burnt within the burner cone 5. Also, it will be burnt outside the burner cone upon mixing with the secondary combustion air from the secondary combustion air passages 11B. This two-step combustion will attenuate the generation of NOx and restrict the expansion of combustion flames, thus producing a minimum of uncombusted gas.

[Action 5]

The first flame stabilizer 7 is arranged in front of the burner cone 5 and spaced by a greater distance from the second flame stabilizer 10 and also, the gas blow apertures 8 of the gas nozzle 4 are located adjacent to the second flame stabilizer 10, as shown in FIG. 11, so that the oscillating combustion can be avoided.

In action, the fuel gas from the gas blow apertures 8 arranged adjacent to the second flame stabilizer 10 runs radially of the second flame stabilizer 10 as accompanied with the primary combustion air while the first flame stabilizer 7 is disposed at a distance from the second flame stabilizer 10. Accordingly, the combustion flames are closely guided by the second flame stabilizer 10 and the stable combustion will be ensured without causing the oscillating combustion.

[Action 6]

A conventional low NOx gas burner produces a ring of extensive combustion flames, thus causing the following drawbacks.

1. The combustion flames are short passed in a recombustion type furnace thus producing a considerable amount of uncombusted gas.

2. When the distance (d) between the second flame stabilizer 10 and the front end of burner cone is increased for controlling the expansion of the combustion flames, the generation of NOx will increase.

Novel means for eliminating the foregoing drawbacks have been searched and developed by us through perpetual experiments and will be described from the clause 1 to 6 as the scope of the prevent invention.

1. The distance d between the second flame stabilizer 10 and the front end of the burner cone 5 is preferably 40 to 80 mm and the second combustion air is guided linearly along the burner cone 5.

2. The first flame stabilizer 7 is disposed adjacent to the front end of the burner cone 5.

3. The gas blow aperture 8 is disposed close to the first flame stabilizer 7 so that its supply of a fuel gas 2 is spaced from the second flame stabilizer 10.

4. The primary combustion air is 20% to 50% of the total combustion air supply,

5. The second flame stabilizer 10 has a multiplicity of apertures 12A provided at random therein for supply of third combustion air (5% to 15% of the total air supply).

6. A diameter of e of the first flame stabilizer 7 is made smaller such that the flow of primary combustion air is prevented from expanding in radial directions.

As depicted in Claim 6 of the present invention, a gas burner is provided comprising a gas nozzle 4 having a first flame stabilizer 7 mounted to the front end thereof and a plurality of gas blow apertures 8 arranged circumferentially therein, a second flame stabilizer 10 having a plurality of secondary combustion air passages 11B arranged at equal intervals in the circumferential end thereof and a primary combustion air passage 11A arranged therein which is defined by the outer surface of the gas nozzle 4, and a burner cone 5 accommodating the second flame stabilizer 10 and arranged in which a mixture of fuel gas 2 and primary combustion air flows radially between the first and second flame stabilizers 7 and 10 as guided by the first flame stabilizer 7 and its portion is mixed with secondary combustion air supplied from the secondary combustion air passages 11B of the second flame stabilizer 10. In particular, the second flame stabilizer 10 is located 40 to 80 mm backward from the front end of the burner cone 5 in which the secondary combustion air runs straight while the first flame stabilizer 7 comes closer to the front end of the burner cone 5 and the gas blow apertures are arranged adjacent to the first flame stabilizer 7.

Each gas blow aperture 8 may be aligned radially of the gas nozzle 4 with its corresponding secondary combustion air passage 11B. It is still desired not to match the gas blow aperture 8 with the passage 11B in position for minimizing the generation of NOx under a variety of combustion conditions.

As depicted in Claim 7 of the present invention, the sectional area of the primary combustion air passage where the fuel gas 2 is also passed is 20% to 50% of the total combustion air passing area in the gas burner according to Claim 6.

As depicted in Claim 8 of the present invention, the second flame stabilizer 10 further has a multiplicity of air supply apertures 12A therein which act as third combustion air passages and of which entire opening area is 5% to 15% of the total combustion air passing area in the gas burner according to Claim 7.

Further preferred arrangements of the present invention will be explained in more detail.

1. The greater the distance d between the second flame stabilizer 10 and the front end of the burner cone 5, the less the combustion flames are expanded for ease of forward propagation. If the distance d is too large, the combustion in the burner cone 5 is stimulated and the separation of flames will be disturbed resulting in increase of NOx. It is thus desired that the distance d is 40 to 80 mm.

2. If the first flame stabilizer 7 is spaced far from the front end of the burner cone 5, the fuel gas tends to flow extensively. The first flame stabilizer 7 is thus arranged close to the front end of the burner cone 5 so that the combustion flames remain short. As the result, the combustion will be executed within the burner cone 5.

3. If the gas blow apertures 8 are close to the second flame stabilizer 10, the fuel gas 2 is involved with a recirculating flow in the downstream of the second flame stabilizer 10 and its concentration in the burner cone 5 becomes high. Hence, the combustion will be accelerated within the burner cone 5 producing NOx. For compensation, the gas blow apertures 8 should be spaced by a distance from the second flame stabilizer 10 and disposed close to the first flame stabilizer 7.

4. If the primary combustion air is abundant (more than 50%), the expansion of the combustion flames increases and produces short passing. The primary combustion air should be less than 50% of the total combustion air supply. If the primary combustion air is too small (less than 20%), the fuel gas 2 tends to be caught by the recirculating flow in the downstream of the second flame stabilizer 10. The primary combustion air should be ranged from 20% to 50% of the total air supply.

5. For controlling the combustion in the burner cone 5 and restricting the generation of NOx, the second flame stabilizer 10 has a multiplicity of apertures 12A arranged therein for supply of third combustion air towards a recirculating area in the downstream of the second flame stabilizer 10. Hence, the concentration of the mixture gas in the area becomes low and the flame stabilizing capability of the second flame stabilizer 10 will be declined. The amount of the third combustion air is preferably 5% to 15% of the total combustion air supply.

6. If the outer diameter (e) of the first flame stabilizer 7 is large, the primary combustion air tends to flow extensively along the first flame stabilizer 7. The diameter e is preferably determined by $c-10\ mm \leqq e \leqq c+30\ mm$ where c is the inner diameter of the primary combustion air passage of the second flame stabilizer 10.

[Action 7]

A further gas burner according to the present invention is provided comprising a gas nozzle 4 having a first flame stabilizer 7*a* mounted to the front end thereof and a plurality of gas blow apertures 8 arranged circumferentially therein adjacent to the first flame stabilizer 7*a*, a second flame stabilizer 10 having a plurality of secondary combustion air passages 11B arranged at equal intervals in the circumferential end thereof and a primary combustion air passage 11A arranged in the center thereof which is defined by the outer surface of the gas nozzle 4, and a burner cone accommodating the second flame stabilizer 10 coupled to the inner wall thereof. In particular, the first flame stabilizer 7*a* is formed of cone shape and the gas blow apertures 8 are aligned radially of the gas nozzle with their respective secondary combustion air passages 11B and also, arranged for supply of a fuel gas at a higher velocity so that the generation of NOx can be minimized.

During combustion, the primary combustion air accompanied with a fuel gas runs radially along the countertapered surface of the first flame stabilizer 7*a*. A resultant mixture gas of the fuel gas and the primary combustion air is then mixed with the secondary combustion air thus producing combustion flames. The combustion will hence be completed before its flames reach the inner wall of a furnace and the generation of uncombusted gas will be averted. Also, the velocity of the fuel gas supply is increased causing proper dispersion of the combustion flames. As the result, lean flame combustion will be produced and the combustion flames will be kept short at a higher temperature. This will minimize the generation of NOx.

[Action 8]

A further gas burner according to the present invention is provided comprising a gas nozzle 4 having a first flame stabilizer 7 mounted to the front end thereof and a plurality of gas blow apertures 8 arranged circumferentially therein, a second flame stabilizer 10 having a plurality of secondary combustion air passages 11B arranged at equal intervals in the circumferential end thereof and a primary combustion air passage 11A arranged in the center thereof which is defined by the outer surface of the gas nozzle 4, and a burner cone 5 accommodating the second flame stabilizer 10. In particular, the second flame stabilizer 10 is supported by support members 16 so that it can move forward and backward in the burner cone 5 so that the generation of uncombusted gas can be declined and the utilization can be enhanced.

Preferably, the gas nozzle 4 comprises a first nozzle 4A provided at the front end with the first flame stabilizer 7 and a second nozzle 4B coupled to the rear end of the first nozzle 4A for allowing the first nozzle 4A to move forward and backward. This will also decline the generation of uncombusted gas and enhance the utilization.

In action, the second flame stabilizer 10 is moved by the support members 16 forward or backward in accordance with the inner diameter or length of a furnace in which the gas burner is installed. Hence, the size and strength of the combustion flames can controlled not to reach the inner wall of the furnace and the generation of uncombusted gas will be minimized. As the gas burner is capable of controlling the combustion flames corresponding to the shape of the furnace, it will be utilized for a variety of industrial applications.

[Action 9]

A similar gas burner to the previous one is provided in which the first gas nozzle 4A of the gas nozzle 4 can be moved forward and backward for controlling the size and strength of the combustion flames. Particularly when the first flame stabilizer 7 is set adjacent to the second flame stabilizer 10, the length of the flames becomes short. Accordingly, the generation of uncombusted gas will be attenuated and the utilization of the gas burner will be enhanced.

[Action 10]

As depicted in Claim 11, a further gas burner is provided comprising a secondary combustion air nozzle 20 having two flame stabilizers 7B and 10A mounted to the front end thereof and also, a plurality of secondary combustion air passages 11*c* arranged circumferentially therein between the two flame stabilizers 7B and 10A, and a gas nozzle 4 mounted around the secondary combustion air nozzle 20 by an annular space which serves as a primary combustion air passage and having a plurality of gas blow apertures 8A provided therein adjacent to the front end. In particular, the combustion air is divided into a primary combustion air flow 21 to be passed through the primary combustion air passage and a secondary combustion air flow 22 to be passed through the secondary combustion air nozzle 20. The primary combustion air flow 21 is utilized for mixing with a fuel gas supplied from the gas nozzle while the secondary combustion air flow 22 is utilized for combustion action so that the mixture gas 23 of the fuel gas and the primary combustion air 21 is discharged radially of the flame stabilizer 10A and produces a ring of gas-rich flames 24 while the secondary combustion air flow 22 from the secondary combustion air passages 11*c* is directed in a radial direction by the flame stabilizer 7B thus producing a ring of air-rich flames 25. More specifically, the secondary combustion air passages 11*c* is formed by having 4 to 8 apertures arranged circumferentially at equal intervals in the second combustion air nozzle 20.

The following advantages will be obtained as the result of action.

1. The primary combustion air to be mixed with the fuel gas is 20% to 50% of the total air supply. Hence, their mixture gas contains the combustion air at a ratio of 0.25 to 0.6 thus producing gas-rich flames and the generation of NOx will be attenuated.

Further, where the secondary combustion air is divided and flown, said mixed and dispersed gas is further mixed with the secondary combustion air and the mixture gas contains the combustion air at a ratio of 1.8 to 2.2 thus producing air-rich flames and also the generation of NOx will be attenuated.

2. As described in FIGS. 21 to 26, the secondary combustion air flows radially of the flame stabilizer 7B and thus, a recirculating flow is developed in the downstream of the flame stabilizer 7B. Due to recirculation of its exhaust gas, the generation of NOx will be minimized.

DETAILED DESCRIPTION OF THE PREFERRED EMBODIMENTS

Embodiment 1

Figure 1:
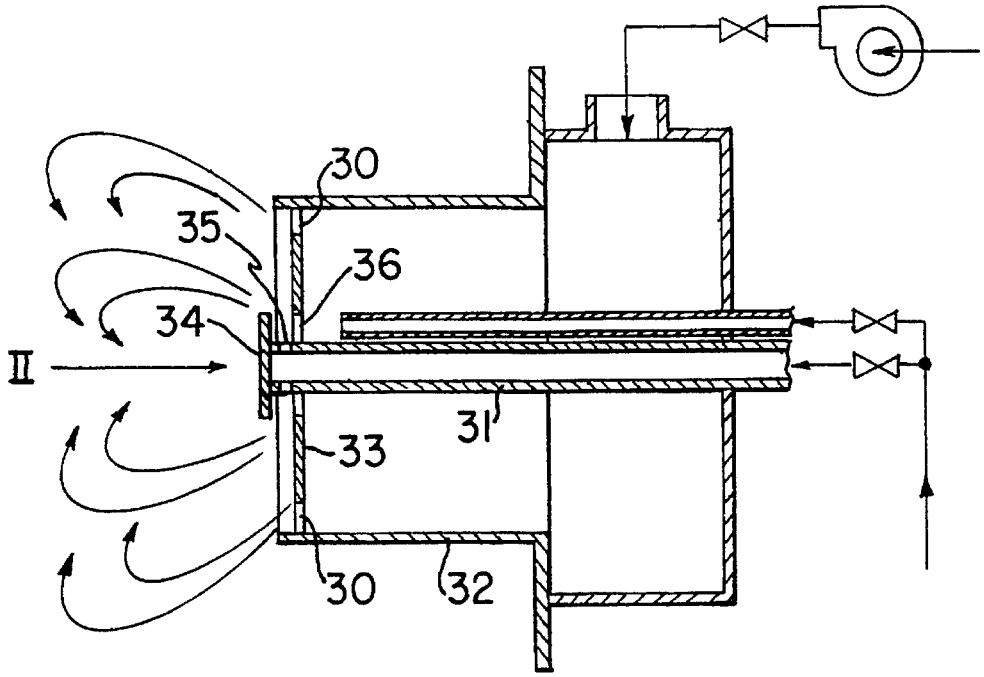
FIG. 1 (PRIOR ART)
FIG. 1 is a cross sectional view of a conventional gas burner.
Figure 2:
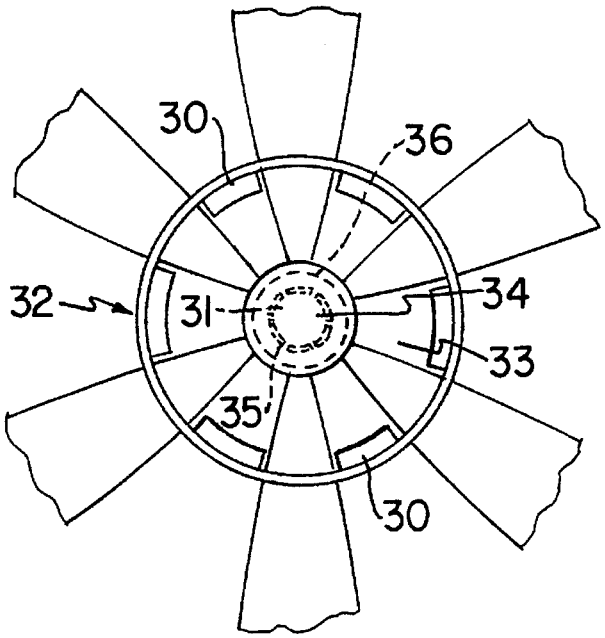
FIG. 2 (PRIOR ART)
FIG. 2 is a front view of the gas burner shown in FIG. 1.
Figure 3:
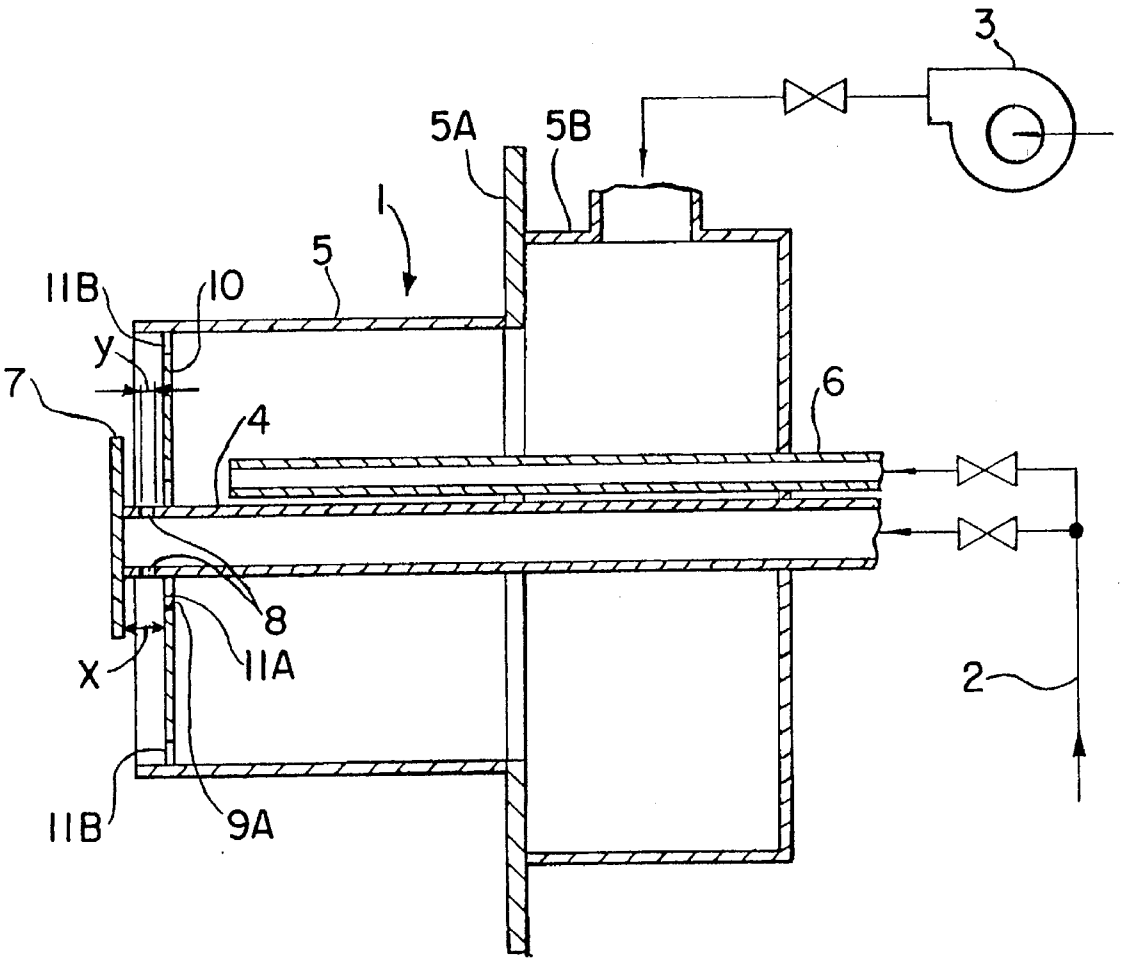
FIG. 3 is a cross sectional view of a gas burner showing a first embodiment of the present invention.

A first embodiment of the present invention will be descried in more detail referring to the accompanying drawings. FIG. 3 is a cross sectional view of a low NOx gas burner denoted by the numeral 1 and FIG. 4 is a front view of the same.

Figure 4:
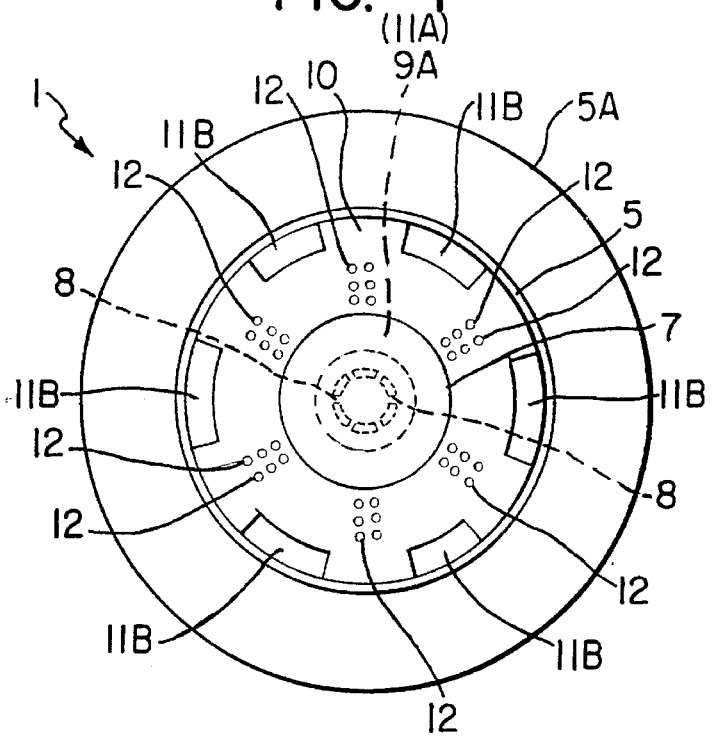
FIG. 4 is a front view of the gas burner shown in FIG. 3.

As shown in FIGS. 3 and 4, the gas burner 1 is arranged for combustion of a fuel gas 2 fed from a gas supply conduit with supply of combustion air from an air blower 3. More specifically, the gas burner 1 comprises a cylindrical gas nozzle 4, a burner cone 5, a burner flange 5A, an air reservoir 5B, and a pilot burner 6.

Also, a first flame stabilizer 7 of disk shape is mounted to the front end of the gas nozzle 4. The gas nozzle 4 has a plurality of gas blow apertures 8 arranged circumferentially at equal intervals in a front end portion thereof adjacent to the first flame stabilizer 7. A second flame stabilizer 10 of disk shape is mounted to the front end of the burner cone 5. The second flame stabilizer 10 has an opening 9A arranged in the center thereof for communication by a primary combustion air passage 11A to the gas nozzle 4. In particular, the distance between the first and second flame stabilizer 7 and 10 should be expressed as:

$$1 \leqq x \leqq 5y$$

where y is the diameter of the gas blow aperture 8. For example, the second flame stabilizer 10 is spaced 10 mm from the first flame stabilizer 7 when the diameter of the gas blow aperture 8 is 5 mm. The second flame stabilizer 10 has a plurality of secondary combustion air passages 11B provided along the circular edge thereof so that they, for example, six as shown in FIG. 4, are arranged not to match the gas blow apertures 8 radially of the gas nozzle 4.

In a combustion action of the gas burner 1, a flow of primary combustion air from the primary combustion air passage 11A is mixed with an amount of fuel gas supplied from the gas blow apertures 8 and directed by the first flame stabilizer 7 to run radially along the second flame stabilizer 10. A resultant mixture gas is burnt with a flow of secondary combustion air from the secondary combustion air passages 11B and its flare extend as separate flames between any two secondary combustion air passages 11B. There is thus developed a recirculation area of exhaust gas in front of the first flame stabilizer 7. More particularly, the heat carried on the exhaust gas is transferred forwardly of the first flame stabilizer 7.

During combustion in the gas burner 1, the fuel/air mixture gas flows radially of the second flame stabilizer 10 so that it can be propagated in all directions. As the result, control over the flame heat is ensured thus allowing the combustion temperature to remain not increased. Hence, the generation of NOx will be restricted to a low level and the concentration of NOx will be maintained low. Also, through the recirculating action of exhaust gas, the heat is fed back from the forward area of the first flame stabilizer 7 to the combustion area and thus, flame propagation will be enhanced.

Figure 5:
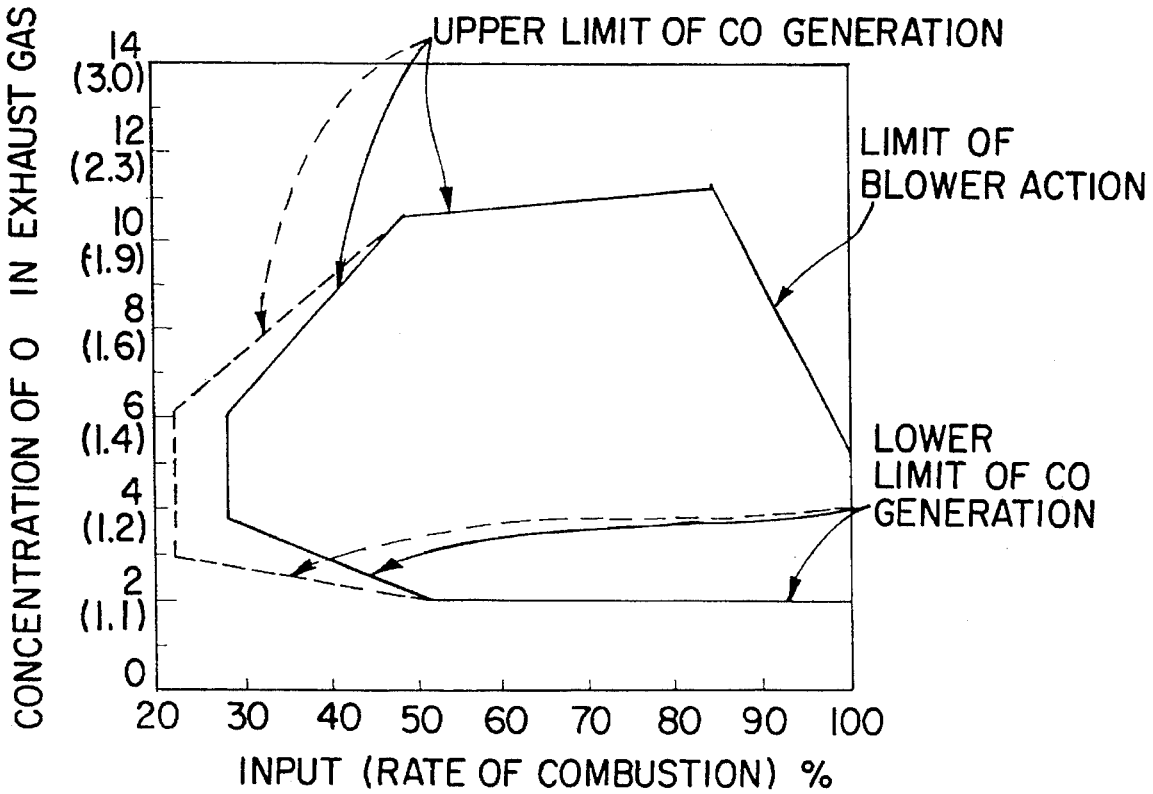
FIG. 5 is a diagram showing a combustion result of the same.

FIG. 5 is a diagram showing a range of proper combustion, in which the combustion is defined by the real line with the second flame stabilizer 10 having no air supply apertures and its lower limit will be as high as 28%. When the second flame stabilizer 10 is perforated to have a multiplicity of air supply apertures 12 so that the flow of secondary combustion air therethrough is increased 5%, the range of combustion becomes expanded as denoted by the dotted line of FIG. 5 and its lower limit will be reduced to 22%. The control of combustion is hence increased by 6%. As shown in FIG. 5, the upper and lower limits of CO generation protect the concentration of $O_2$ in exhaust gas from becoming high and the generation of CO from sharply increasing respectively.

Embodiment 2

Figure 6:
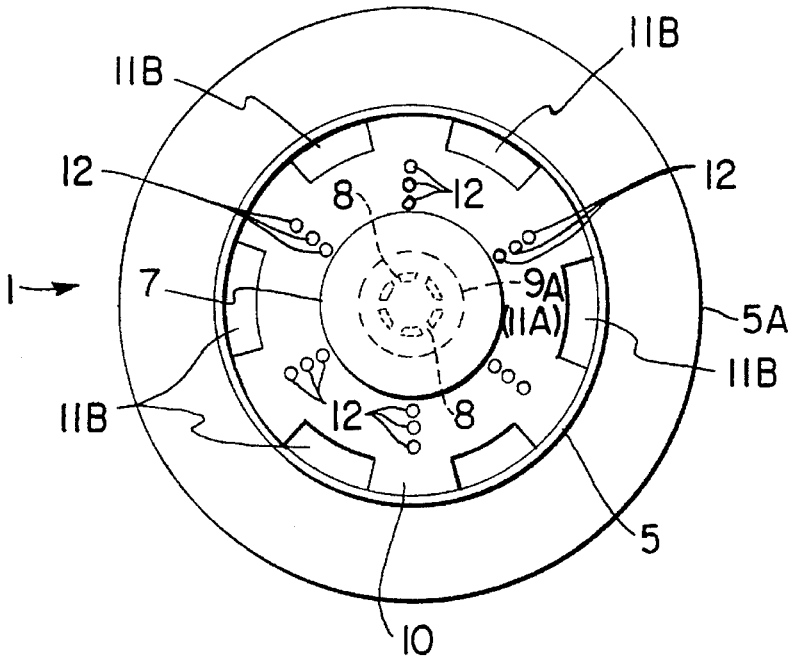
FIG. 6 is a front view of a gas burner showing a second embodiment of the present invention.

FIG. 6 illustrates a second embodiment of the present invention, in which like components are denoted by like numbers as of the first embodiment shown in FIG. 4 and will no more be explained. The second flame stabilizer 10 of a gas burner of FIG. 6 has groups, e.g. three a group, of air supply apertures 12 arranged at equal angles to align radially with corresponding gas blow apertures 8 of a gas nozzle 4.

During operation of the gas burner shown in FIG. 6, a fuel/air mixture gas when running radially of the second flame stabilizer 10 is stimulated with the supply of secondary combustion air from the air supply apertures 12 so that it can at consistency be burnt within a wider combustion range. Also, the secondary combustion air from the air supply apertures 12 of the second flame stabilizer 10 flows towards the center or highest concentration portion of a stream of the mixture gas from its lower. This allows the mixture of air with the gas to be executed at high efficiency without disturbing the reduction of NOx by flame distribution and separation. In particular, the optimum mixture of the fuel gas and the air may be conducted with supply of 4% the secondary combustion air from the air supply apertures 12.

Embodiment 3

Figure 7:
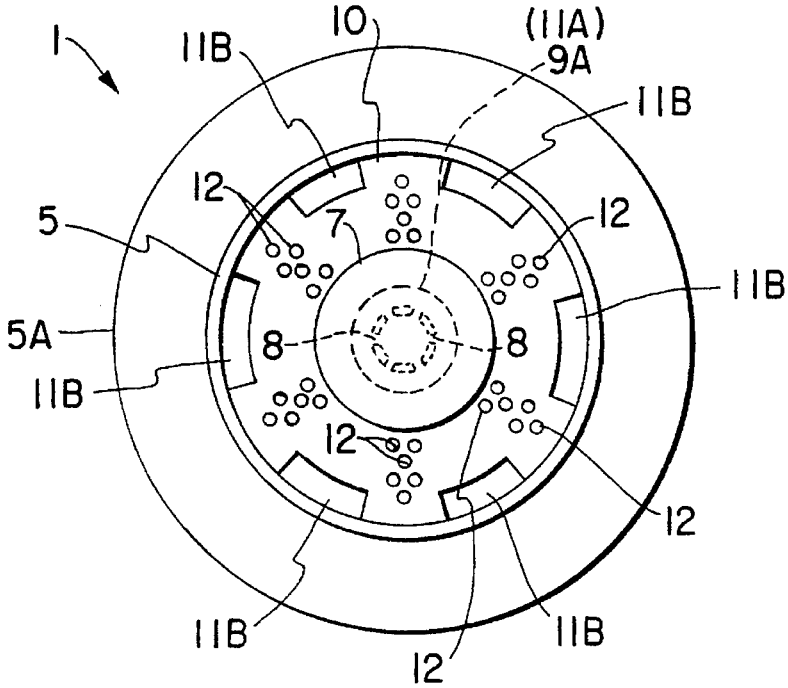
FIG. 7 is a front view of a third embodiment, a modification of the gas burner shown in FIG. 6.

FIG. 7 illustrates a third embodiment of the present invention, in which like components are denoted by like numbers as shown in FIG. 4 and will no more be explained. As shown in FIG. 7, the second flame stabilizer 10 of a gas burner has groups of air supply apertures 12. The apertures 12 of each group are arranged in stagger relationship so as to correspond at a right angle to each gas blow aperture 8 of the gas nozzle 4.

In action, the secondary combustion air from the air supply apertures 12 can be directed towards the center and both the sides of a mixture gas stream for optimum mixing action without disturbing the reduction of NOx, thus allowing more stable combustion to be executed in an extensive area. The gas burner of the third embodiment may be operated optimum with supply of as high as 8% the secondary combustion air from the air supply apertures 12.

Embodiment 4

Figure 8:
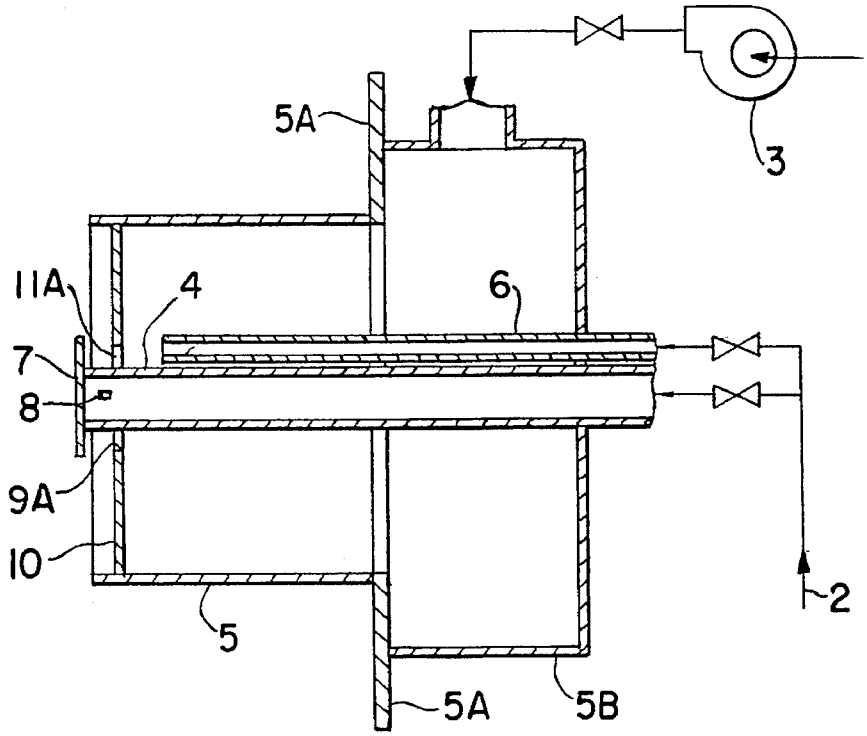
FIG. 8 is a cross sectional view of a gas burner showing a fourth embodiment of the present invention.
Figure 9:
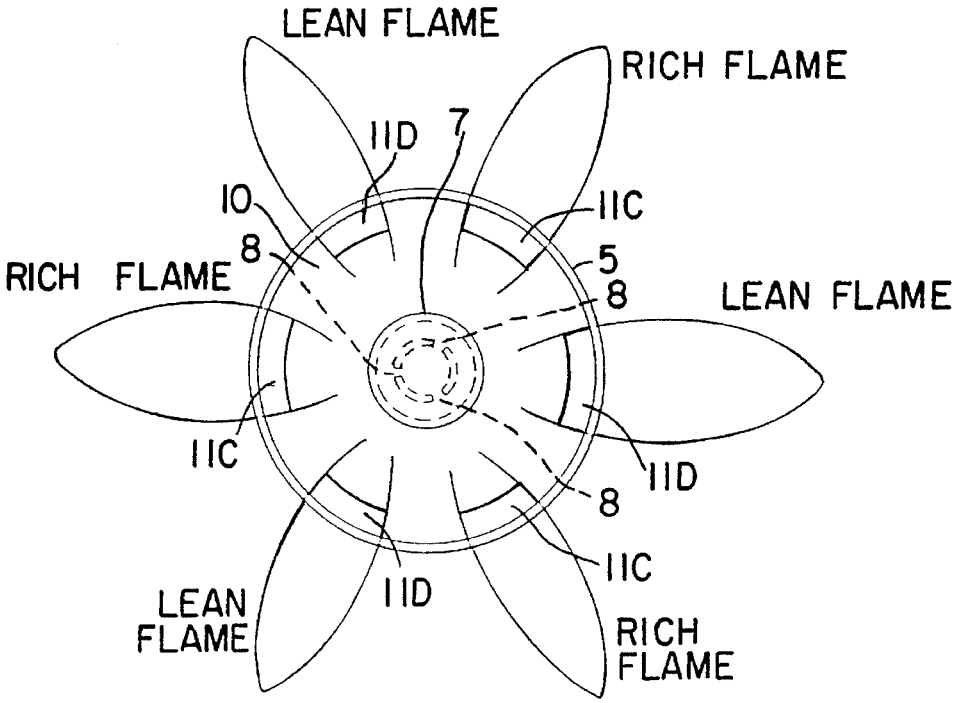
FIG. 9 is a front view of the gas burner shown in FIG. 8.

As shown in FIGS. 8 and 9, the gas nozzle 4 has a first flame stabilizer 7 of disk shape mounted to the front end thereof. The outer diameter of the first flame stabilizer 7 is greater than the diameter of a center opening 9A of the second flame stabilizer 10. Preferably, for example three of the gas blow apertures 8 are provided adjacent to the first flame stabilizer 7 in the gas nozzle 4 so that they align along the circumference of the gas nozzle 4 and correspond to alternate ones 11C of the secondary combustion air passages 11C,11D which are arranged in the outer edge of the second flame stabilizer 10. More specifically, while the three gas blow apertures 8 are provided, the number of the secondary combustion air passages 11C,11D is six or doubled.

In combustion, the primary combustion air (10% to 50% of the total amount) is passed along the gas nozzle 4 behind the second flame stabilizer 10 and flows out through a primary combustion air passage 11A. The flow of the primary combustion air from the primary combustion air passage 11A is mixed with a fuel gas fed from the gas blow apertures 8 and turned by the first flame stabilizer 7 to move radially of the second flame stabilizer 10. A resultant mixture gas of the primary combustion air and the fuel gas is thus burnt in combination with the secondary combustion air from the secondary air passages 11C as flowing along the second flame stabilizer 10. Each combustion flame produced directly at the gas blow aperture 8 contains a high concentration of the fuel gas (which will hence be referred to as a rich flame hereinafter). Every combustion flame between the two rich flames is produced by combination of a diluted fuel gas and the secondary combustion air from the secondary air passage 11C and thus, contains a low concentration of the fuel gas (which will be referred to as a lean flame). As the result, the rich and lean flames appear alternately as shown in FIG. 9.

The gas burner of this embodiment has the gas blow aperture 8 provided half the number of the secondary combustion air passages 11C,11D in which 11C corresponds to each gas blow aperture 8 and 11D is an extra passage for supply of abundant air. Accordingly, rich and lean combustion flames are developed alternately thus lowering a total temperature in the combustion. This can minimize the generation of unwanted NOx gas.

It would be understood that the above-described embodiment is not limited to the three gas blow apertures 8. Four or more of the gas blow apertures 8 can be provided in the gas nozzle 4 depending on the capability of a gas burner. Also, the secondary combustion air passages 11 can be arranged two times the number of the gas blow apertures 8 for producing a ring of rich and lean flames. Hence, the gas burner can perform a combination of rich and lean flame combustion actions thus reducing the generation of NOx.

Embodiment 5

Figure 10:
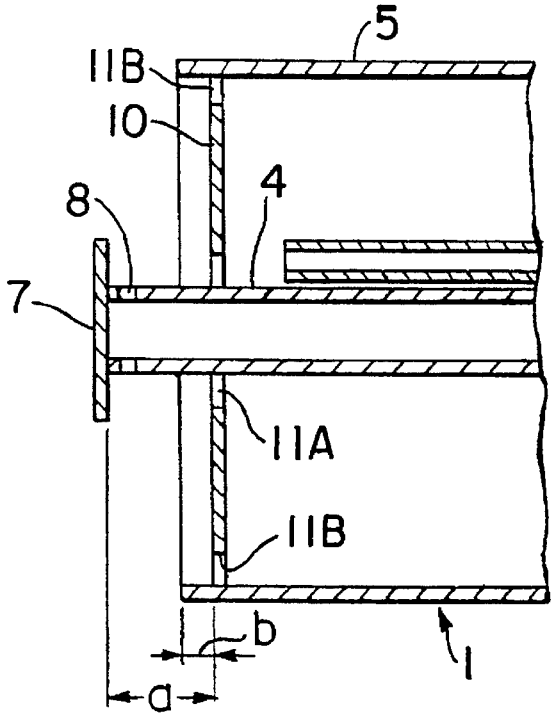
FIG. 10 is a cross sectional view of the primary part of a gas burner showing a fifth embodiment of the present invention.

FIG. 10 shows a fifth embodiment of the present invention, in which a first flame stabilizer 7 is mounted to the front end of a gas nozzle 4 which extends outward from the front side of a burner cone 5. The first flame stabilizer 7 is spaced by a given distance a, e.g. 12 cm, from a second flame stabilizer 10. The second frame stabilizer 10 is mounted to the burner cone 5 at a location distance b, e.g. 3 cm, from its front end. The distance a is about 4 times greater than the distance b. The gas nozzle 4 also has a plurality of gas blow apertures 8 arranged at equal intervals along the circumference thereof and adjacent to the first flame stabilizer 7.

As the gas nozzle 4 and the first flame stabilizer 7 are disposed in front of the burner cone 5 and the distance between the first and second flame stabilizers 7,10 is great enough, a flow of primary combustion air from the primary passage 11A after mixed with a fuel gas will be held by the first flame stabilizer 7 so that a resultant mixture gas is burnt within the diameter of the burner cone 5 (at a first combustion step). The mixture gas is then burnt by a flow of secondary combustion air supplied from the second air passages 11B of the second flame stabilizer 10 (at a second combustion step) thus performing a combustion action outside the cross section of the burner cone 5. At the first combustion step, the concentration of the fuel gas is high and its gas-rich area can be maintained at a low degree of the combustion temperature thus producing a small amount of NOx gas. At the second combustion step, the concentration of the fuel gas becomes low and its air-rich area can be further reduced in the combustion temperature (due to extra supply of combustion air) thus producing a smaller amount of NOx. Also, the gas blow apertures 8 are arranged adjacent to the first flame stabilizer 7 so that two step combustion is much enhanced and the generation of NOx can thus be attenuated.

As the first combustion step is executed within the diameter of the burner cone 5 and the second combustion step is implemented outside the cross section of the burner cone 5, the expansion of combustion flames can be controlled to a minimum. When installed in a small sized furnace, the gas burner will hence prevent its flames from reaching the inner wall of the furnace and minimize the generation of uncombusted gas.

Furthermore, the gas burner shown in FIG. 10 has the gas blow apertures 8 arranged adjacent to the first flame stabilizer 7 so that flame stabilization can be less effected at the second flame stabilizer 10. Accordingly, any fast combustible fuel gas can be burnt by the gas burner with equal stability.

Embodiment 6

Figure 11:
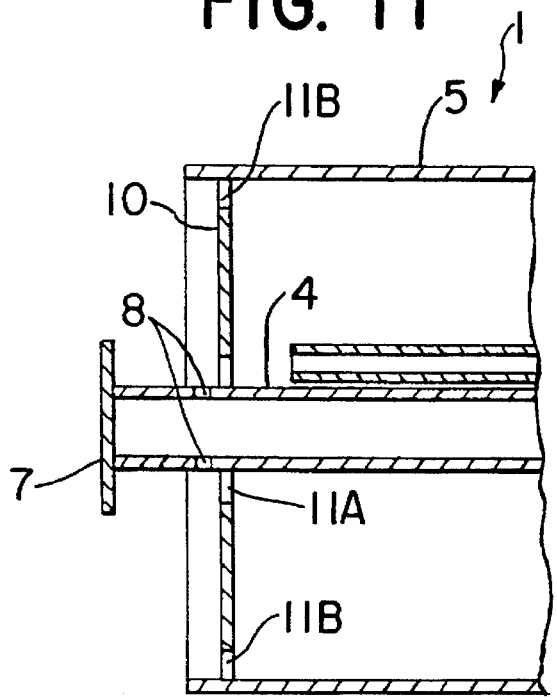
FIG. 11 is a cross sectional view of the primary part of a gas burner showing a sixth embodiment of the present invention.

FIG. 11 shows a sixth embodiment of the present invention, in which the gas blow apertures 8 of a gas nozzle 4 are arranged adjacent to the second flame stabilizer 10. The gas burner of the sixth embodiment can also attenuate the generation of NOx through two-step combustion with a like arrangement as shown in FIG. 10. Hence, the expansion of combustion flames will be controlled and the generation of uncombusted gas will be minimized.

The second flame stabilizer 10 accompanied closely with the gas blow apertures 8 tends to encourage a flame stabilizing effect and thus, a slow combustible fuel gas can steadily be burnt without causing oscillating combustion.

Embodiment 7

Figure 12:
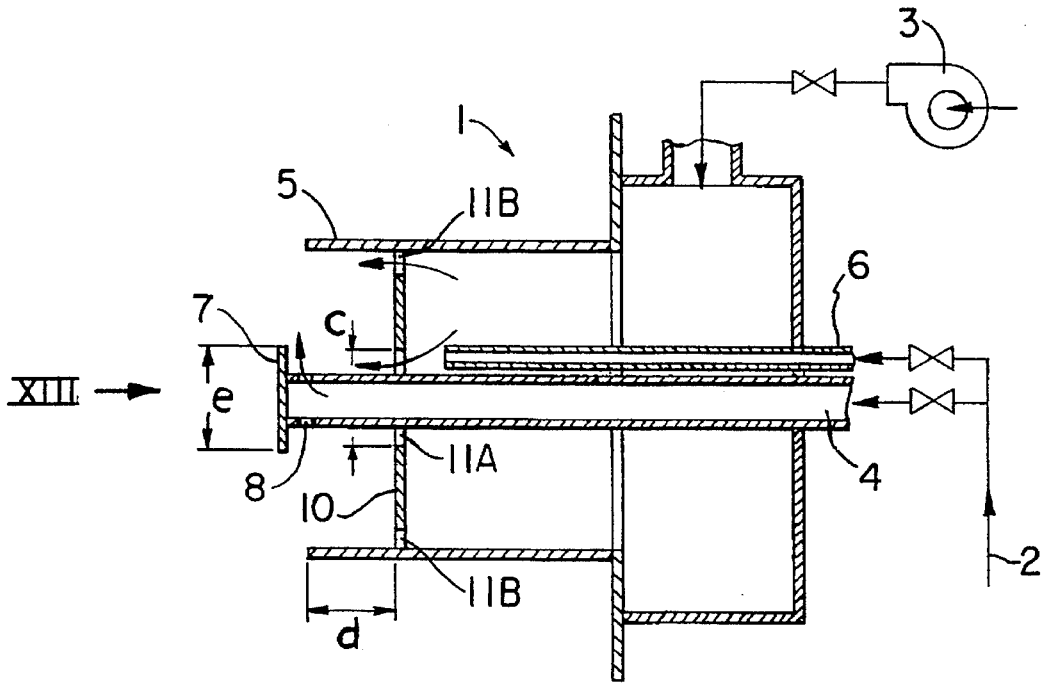
FIG. 12 is a cross sectional view of a gas burner showing a seventh embodiment of the present invention.
Figure 13:
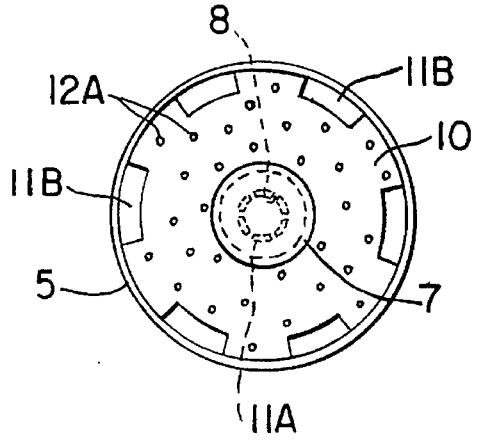
FIG. 13 is a front view of the gas burner shown in FIG. 12.

FIGS. 12 and 13 illustrate a low NOx gas burner according to a seventh embodiment of the present invention, which is not limitative and other modifications will be possible without departing from the scope of the invention.

FIG. 12 is a cross sectional view of the low NOx gas burner and FIG. 13 is a side view of the same seen from the XIII direction of FIG. 12.

The gas burner 1 which is designed for combustion of a fuel gas 2 with a supply of combustion air fed from a blower 3, comprises a gas nozzle 4 provided at front end with a first flame stabilizer 7 and having a plurality of gas blow apertures 8 arranged circumferentially in the surface thereof and a burner cone 5 having a second flame stabilizer 10 mounted thereto at a location spaced by d (mm) from its front end. The first flame stabilizer 7 has a diameter of e (mm) and is disposed in proximity to the front end of the burner cone 5. The second flame stabilizer 10 has at center a primary combustion air passage 11A (of c mm in inner diameter) through which the gas nozzle 4 extends and a plurality of secondary combustion air passages 11B arranged at equal intervals on the outer edge thereof. The gas blow apertures 8 are located close to the first flame stabilizer and far from the second flame stabilizer 10. The second flame stabilizer 10 has also a multiplicity of apertures 12A constituting third air passages for supply of combustion air.

1. The combustion air from the blower 3 flows into the gas burner 1 where it is divided by the second flame stabilizer 10 into three, primary, secondary, and third, streams.

2. The primary combustion air (about 20 to 50% of the total combustion air) runs along the gas nozzle 4 and passes through the primary combustion air passage 11A between the second flame stabilizer 10 and the gas nozzle 4. Then, as being accompanied with the fuel gas at the front end of the gas nozzle 4, the primary combustion air is guided by the first flame stabilizer 7 to flow radially. Preferably, the distance d is 50 mm.

3. The secondary combustion air flows straightly along the inner wall of the burner cone 5 and passes through the secondary combustion air passages 11B of the second flame stabilizer 10. Then, it is mixed with a mixture gas of the fuel gas and the primary combustion air for combustion.

4. The secondary combustion air is fed in separate streams so that resultant combustion flames can blaze separately and thus, remain not radially extended but towards the forward.

5. The third air, 5% to 15% of the total combustion air, is fed through the apertures 12A provided in the second flame stabilizer 10 for further stimulation of the combustion. The third air produces air excessive flames and thus, the generation of NOx will be reduced.

6. After the second flame stabilizer 10, a recirculating stream of the mixture gas is cooled down with the third combustion air so that the concentration of the fuel gas can be declined. Accordingly, backfire in the burner cone 5 will be prevented and the generation of NOx will be avoided.

7. As the combustion is carried out at a main region where the primary combustion air (or mixture gas) is mixed with the secondary combustion air, its separate combustion flames produce a wall of fire while the fuel gas from the center of the burner cone 5 circulates therein. This action will minimize the generation of NOx.

A test of combustion of the fuel gas with the low NOx gas burner shown in FIG. 12 was conducted (at a fuel gas supply of 50 $m^3$/hr and under a gas pressure of 200 $mmH_2O$).

Figure 14:
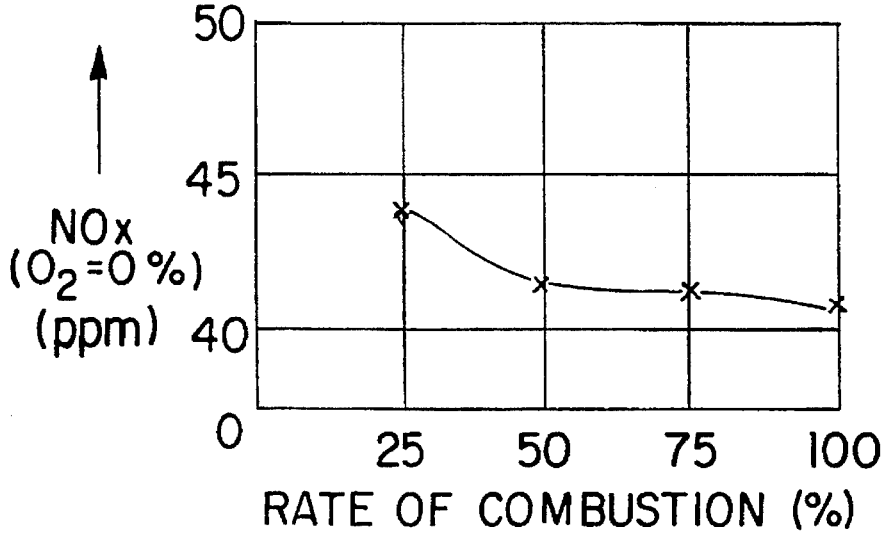
FIG. 14 is a diagram showing the relation between combustion rate and NOx concentration in exhaust gas.

FIG. 14 shows the resultant concentration of NOx in an exhaust gas when the effectiveness of combustion is varied from 25% to 100% in the gas burner. As apparent, the concentration of NOx is as low as 40 to 45 ppm at $O_2$=0%.

Figure 15:
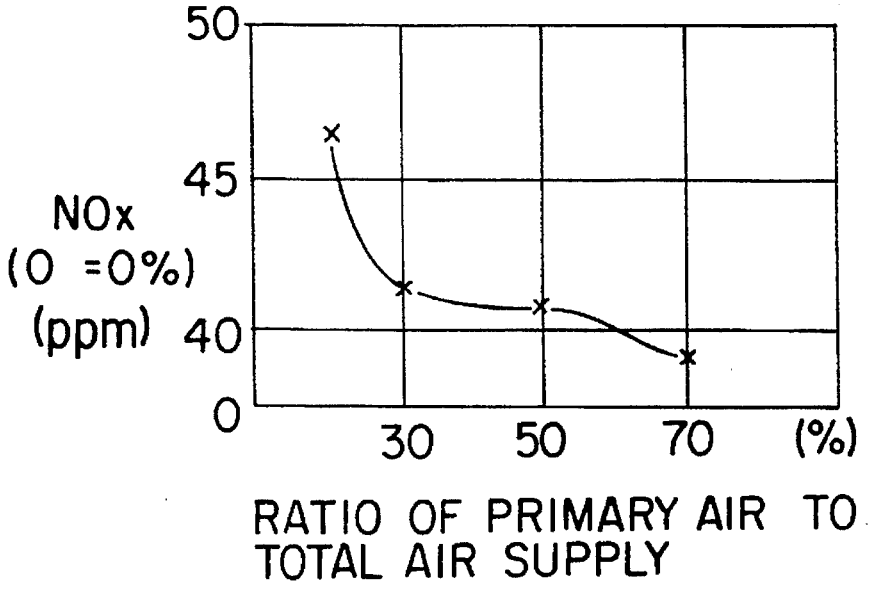
FIG. 15 is a diagram showing the relation between ratio of primary combustion air to total air supply and Nox concentration in exhaust gas.

FIG. 15 shows the measurements of NOx concentration in the exhaust gas when the primary combustion air was varied from 20% to 70% of the total supply of combustion air. As apparent, the concentration of NOx is as low as 40 to 47 ppm at $O_2$=0%.

Embodiment 8

Figure 16:
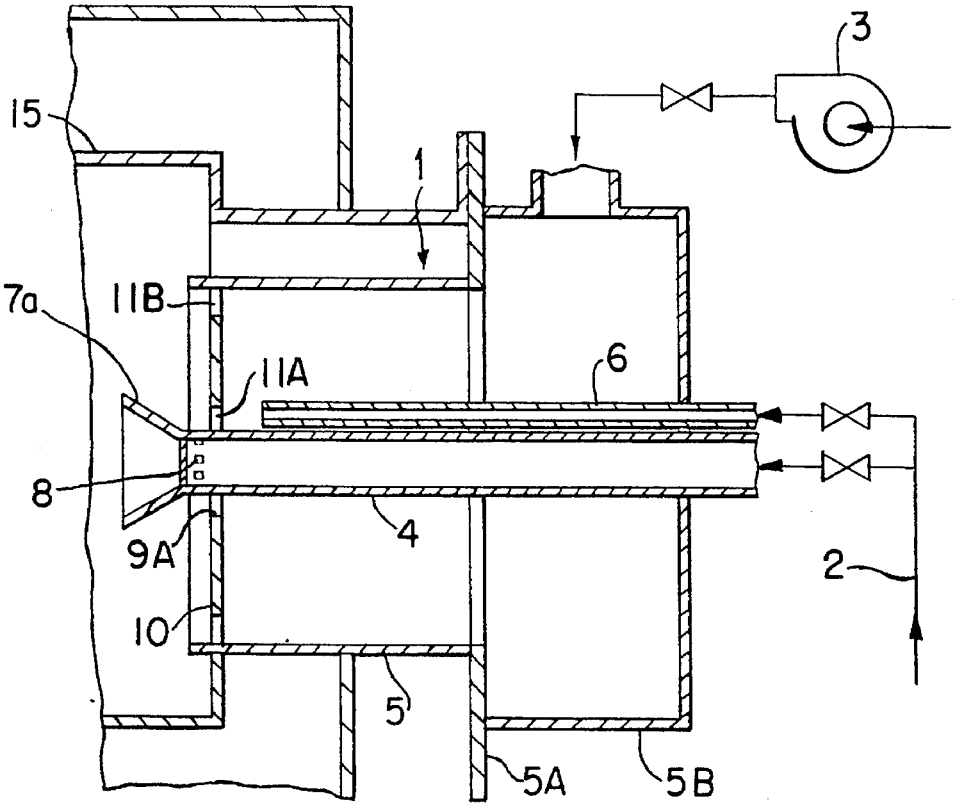
FIG. 16 is a cross sectional view of a gas burner in a defroster showing a eighth embodiment of the present invention.
Figure 17:
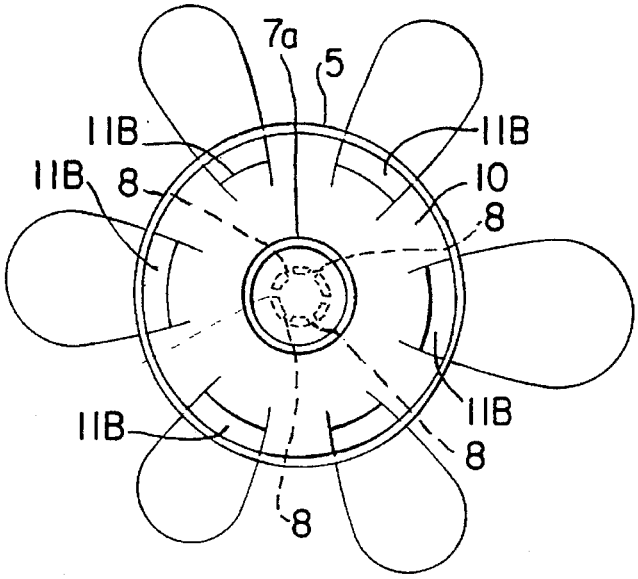
FIG. 17 is a front view of the gas burner shown in FIG. 16.

FIGS. 16 and 17 shows a gas burner 1 according to a eighth embodiment of the present invention, which is designed for combustion of fuel gas fed from a gas supply conduit with combustion air supplied from a blower 3. The gas burner 1 comprises a gas nozzle 4 of tubular shape, a burner cone 5, a burner flange 5A, an air chamber 5B, and a pilot burner 6.

A first flame stabilizer *7a* of cone shape is mounted to the front end of the gas nozzle 4. The gas nozzle 4 has a plurality of gas blow apertures 8 of e.g. 3 mm in diameter arranged at equal intervals along the circumference thereof adjacent to the first flame stabilizer *7a*. A second flame stabilizer 10 of disk shape is mounted to the front end of the burner cone 5. The second flame stabilizer 10 has at center an opening 9A which constitutes a primary combustion air passage 11A defined by the gas nozzle 4. The second flame stabilizer 10 also has a plurality, six in this embodiment, of second air passages 11B arranged at equal intervals along the outer edge thereof. In particular, each of the six second air passages 11B is aligned with its corresponding gas blow aperture 8 radially of the gas nozzle 4.

The gas burner 1 is installed in a furnace 15 which serves as e.g. a defroster of an absorption freezer machine. The furnace 15 is enclosed with a (lithium bromide) solution jacket.

In action of the gas burner 1, a primary stream of combustion air from the primary combustion air passage 11A passes the second flame stabilizer 10 and as being accompanied with a fuel gas fed from the gas blow apertures 8 of the gas nozzle 4, runs radially along the countertapered surface of the first flame stabilizer *7a*. A resultant mixture gas of the fuel gas and the primary combustion air is then mixed with a secondary stream of air supplied from the secondary combustion air passages 11B of the second flame stabilizer 10 thus producing combustion flames. As the six secondary combustion air passages 11B are arranged corresponding to their respective gas blow apertures 8 of the gas nozzle 4, the flames will be much excited with the secondary combustion air and readily ceased down prior to reaching the inner wall of the furnace 15.

Also, the gas blow apertures 8 are formed small in the diameter to increase the blowing velocity of the fuel gas. Hence, the fuel gas will quickly be dispersed producing a ring of lean flames.

According to the eighth embodiment, the cone-shaped first flame stabilizer *7a* mounted to the front end of the gas nozzle 4 permits the fuel/air mixture gas to flow radially along its countertapered surface. The second air passages 11B arranged corresponding to the gas blow apertures 8 of the gas nozzle 4 supply their secondary air streams for mixing with the mixture gas and thus, stimulating the combustion action. As the result, the combustion will be completed before the combustion flames reach the inner wall of the furnace thus averting the generation of uncombusted gas such as CO gas.

Such excitement of the combustion with supply of the secondary combustion air may involve generation of more NOx gas. However, the faster gas blowing velocity produces an enlargement of combustion flames, as the result, the combustion flames becomes lean and will remain short to provide the heat of a high temperature. Hence, the generation of NOx will be minimized.

Embodiment 9

Figure 18:
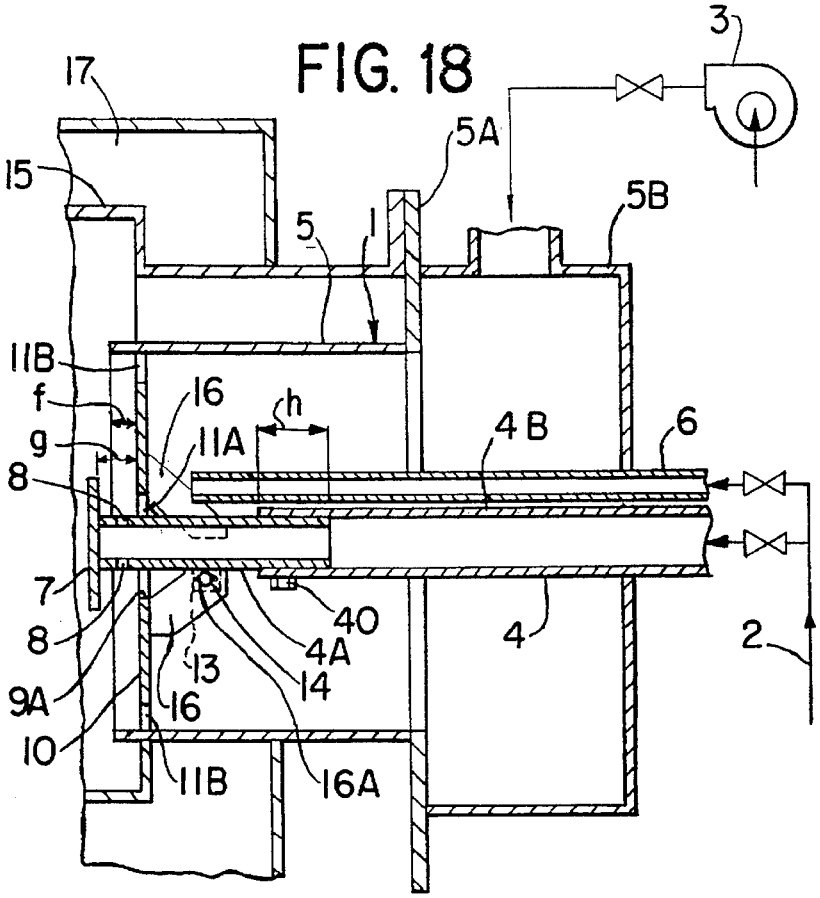
FIG. 18 is a cross sectional view of a gas burner showing an ninth embodiment of the present invention.
Figure 19:
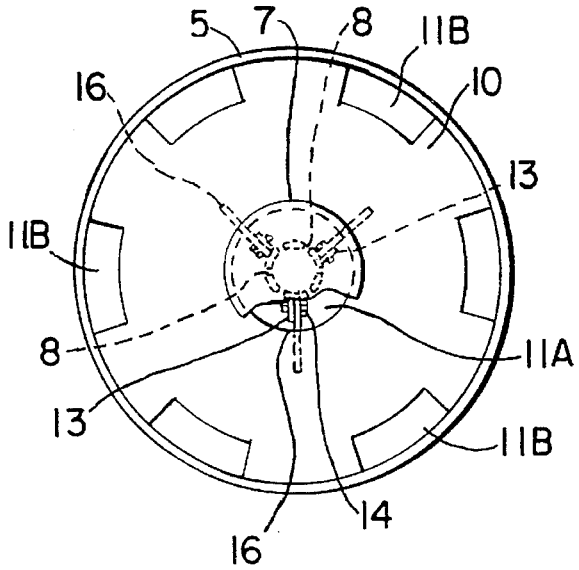
FIG. 19 is a front view of the gas burner shown in FIG. 18.

FIGS. 18 and 19 show a gas burner 1 designed for combustion of a fuel gas 2 fed from the gas supply conduit with supply of combustion air from a blower 3. The gas burner 1 comprises a gas nozzle 4 of tubular shape, a burner cone 5, a burner flange 5A, an air chamber 5B, and a pilot burner 6. The gas nozzle 4 comprises a first nozzle 4A extending axially across the center of the burner cone 5 and a second nozzle 4B coupled by overlap joint to the rear end of the first nozzle 4A. The overlap joint between the first and second nozzles 4A,4B is fastened with a retainer screw 4C.

A first flame stabilizer 7 is mounted to the front end of the gas nozzle 4. The gas nozzle 4 has a plurality of gas blow apertures 8 of e.g. 3 mm in diameter arranged at equal intervals along the circumference thereof adjacent to the first flame stabilizer 7. A second flame stabilizer 10 of disk shape is mounted to the front end of the burner cone 5. The second flame stabilizer 10 has at center an opening 9A which constitutes a primary combustion air passage 11A defined by the gas nozzle 4. The second flame stabilizer 10 also has a plurality, six in this embodiment, of second air passages 11B arranged along the outer edge thereof. In particular, the six second air passages 11B are circumferentially arranged alternate with the six gas blow apertures 8, as shown in FIG. 19.

The second flame stabilizer 10 is supported by support plates (supporting members) 16 which are secured at one end by e.g. welding to the inner side of the second flame stabilizer 10. Each support plate 16 has a horizontal slot 16A provided in the first nozzle 4A end thereof. In this embodiment, three of the support plates 16 are arranged at intervals of 120° for supporting the second flame stabilizer 10. Also, three retainer tabs 13 are mounted at intervals of 120° by e.g. welding to the outer surface of the first nozzle 4A so that they can be coupled with their respective support plates 16. Each retainer tab 13 is coupled to its corresponding support plate 16 by a screw 14 inserted into the slot 16A of the support plate 16. The second flame stabilizer 10 can thus be moved forward and backward for positioning adjustment with its slot 16a relative to the screw 14.

The gas burner 1 is installed in a furnace 15 which serves as e.g. a defroster of an absorption freezer machine. The furnace 15 is enclosed with a (lithium bromide) solution jacket 17.

In installation of the gas burner 1 to the furnace 15, the second flame stabilizer 10 is mounted backward when the inner diameter of the furnace 15 or the distance between the inner wall of the furnace 15 and the gas burner 1 is small. Also, the first nozzle 4A is moved backward with the retainer screw 4C being loosened, thus retracting the first flame stabilizer 7 into the burner cone 5. As the result, the distance f from the front end of the burner cone 5 to the second flame stabilizer 10 becomes greater than the distance g between the first and second flame stabilizers 7,10 while the overlapping h between the first and second nozzles 4A,4B is increased, as shown in FIG. 18.

In action of the gas burner 1 having desired values of the distances f and g, a primary stream of combustion air from the primary combustion air passage 11A is mixed with a fuel gas fed from the gas blow apertures 8 of the gas nozzle 4 and a resultant mixture gas runs radially along the first flame stabilizer 7. The mixture gas further flows closely along the outer wall of the second flame stabilizer 10 to the inner wall of the burner cone 5 and then, turns to move in a horizontal direction. Hence, its combustion flames are restricted in radial expansion and thus, run horizontally allowing the combustion to be executed within the burner cone 5.

When the furnace 15 is short in the length but large in the diameter, the second flame stabilizer 10 is mounted forward by adjusting the slot 16A with the retainer screw 4C and decreasing the distance f. Also, the first nozzle 4A is moved forward to set the first flame stabilizer 7 in front of the burner cone 5. Accordingly, the distance g becomes greater than the distance f and the overlapping h is decreased.

As understood, the mixture gas of the fuel and the combustion air is not restricted by the front end of the burner cone 5 and flows radially of the first flame stabilizer 7 situated forward towards the outside of the burner cone 5. Hence, its combustion flames extend radially and become large in length. Also, the recirculating area for exhaust gas in the downstream of the first flame stabilizer 7 is widened thus increasing the velocity of combustion.

According to this embodiment, the second flame stabilizer 10 is arranged for forward and backward movement through adjusting the relative position of the slots 16A of the support plates 16 to the retaining tabs 13 while the first nozzle 4A is also arranged for slide movement with the retainer screw 4C being loosened. Accordingly, the first and second flame stabilizers 7 and 10 can be moved to their desired locations corresponding to the inner shape, length, or diameter of the furnace 15 in which the gas burner 1 is installed.

If the furnace 15 is small in the diameter, the two flame stabilizers 7 and 10 are mounted backward for restricting the radial expansion of combustion flames and directing them in a horizontal direction. Hence, the combustion will be completed within the burner cone 5 before the combustion flames reach the inner wall of the furnace thus averting the generation of uncombusted gas. If the furnace 15 is large in the diameter and short in the length, the two flame stabilizers 7 and 10 are mounted forward for allowing the combustion flames to extend outward from the burner cone 5. Hence, the combustion becomes stimulated thus shortening its flame length. The combustion flames will hardly reach smoke or water tubes and the generation of uncombusted gas will be decreased.

Accordingly, the gas burner of the embodiment is capable of controlling the size of combustion flames corresponding to the shape of a furnace, whereby its utilization will be enhanced and the generation of uncombusted gas will be minimized.

As the positional relation between the first and the second frame stabilizer 7 and 10 of this embodiment is controlled depending on the shape of the furnace, the first flame stabilizer 7 may be moved to and from the burner cone 5 by adjusting the first nozzle 4A while the second flame stabilizer 10 remains unchanged. As the result, the extension or length of the combustion flames is determined to optimum and the gas burner can be used for various applications and will attenuate the generation of uncombusted gas.

Also, while the first flame stabilizer 7 remains inside or outside the burner cone 5, the second flame stabilizer 10 may be moved forward or backward for controlling the size of combustion flames. Hence, the gas burner becomes applicable to a variety of uses and will attenuate the generation of uncombusted gas.

The two distances f and g can be varied through adjusting both the first nozzle 4A and the second flame stabilizer 10 simultaneously to match the shape of the furnace. More particularly, the relation between the two distances f and g can be altered and the utilization of the gas burner will be enhanced.

Embodiment 10

Figure 20:
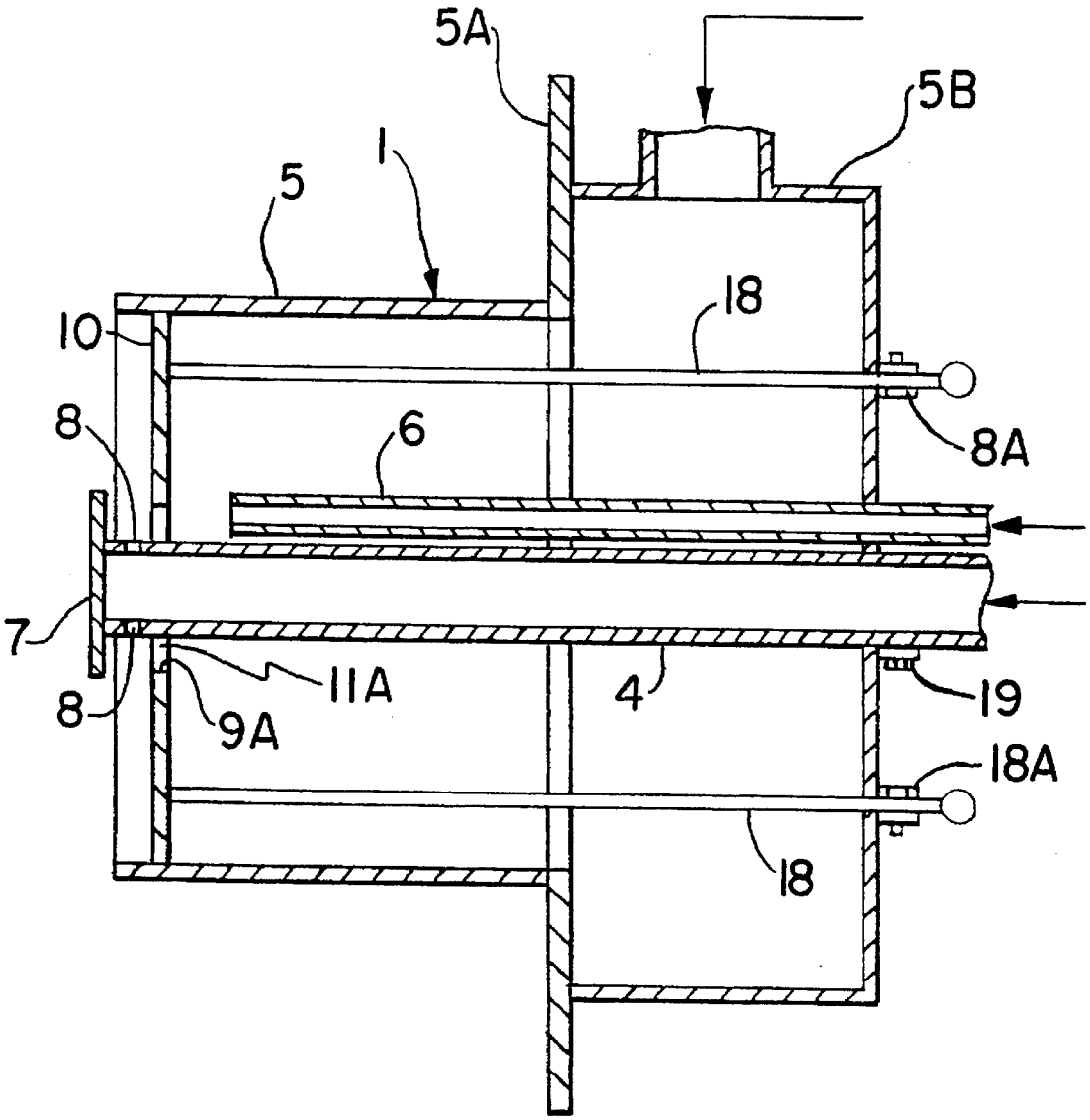
FIG. 20 is a cross sectional view of a gas burner showing a tenth embodiment of the present invention.

As illustrated in FIG. 20, a movable handle (supporting member) 18 is provided which extends from the outside through the air chamber 5B to the inner wall of the second flame stabilizer 10. Preferably, two of the movable handles 18 are coupled to upper and lower regions of the second flame stabilizer 10 and can be tightened by screws 18A to the side of the air chamber 5B. Also, the first flame stabilizer 7 is mounted to the front end of a gas nozzle 4 which extends backward through the air chamber 5B to e.g. a flexible gas conduit (not shown) arranged in the outside. The gas nozzle 4 is tightened by a screw 19 to the side of the air chamber 5B.

Accordingly, the second frame stabilizer 10 can be moved forward and backward using the two movable handles 18,18 and also, the gas nozzle 4 can be adjusted to a position corresponding to the shape of a furnace. For example, when the furnace is small in the diameter, the second flame stabilizer 10 is moved backward by pulling the two handles 18,18 and simultaneously, the gas nozzle 4 is retracted to set the first flame stabilizer 7 in the burner cone 5. When the furnace is large in the diameter but short in the length, the second flame stabilizer 10 is moved forward by pressing the two handles 18,18 and the gas nozzle 4 with the first flame stabilizer 7 is advanced to an appropriate position. Hence, the first and second flame stabilizers 7 and 10 are positioned in optimum relationship so that gas burner is improved in the utilization and thus produces less amounts of uncombusted gas.

The second flame stabilizer 10 can be moved for optimum positioning by controlling the two movable handles 18,18 while the combustion state in the gas burner being observed. At the same time, the gas nozzle 4 can be controlled to move the first flame stabilizer 7 to an appropriate position. Accordingly, the combustion will be maintained stable and the generation of uncombusted gas will be minimized.

According to this embodiment like the preceding embodiment, the first or second flame stabilizer 7 or 10 can separately be moved to locate in best relation to the other for combustion in a given shape of the furnace. Also, simultaneous controlling the two, first and second, flame stabilizers 7 and 10 involves more enhancement in the utilization.

Embodiment 11

Example 11

Figure 21:
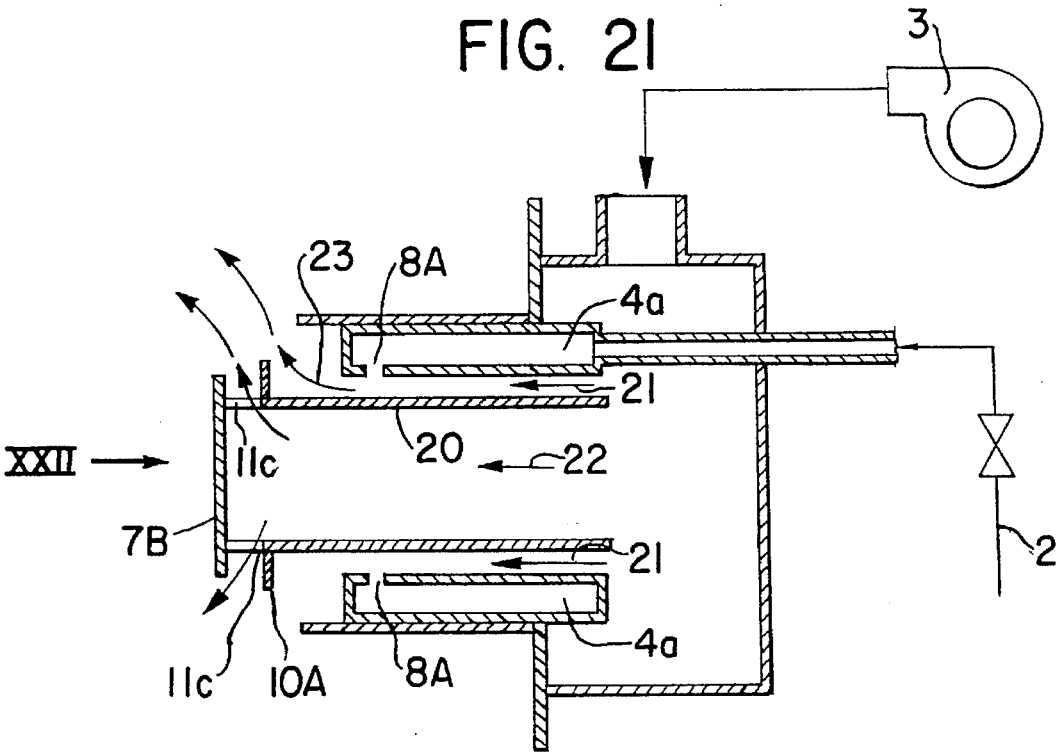
FIG. 21 is a cross sectional view of a gas burner showing a eleventh embodiment of the present invention.
Figure 22:
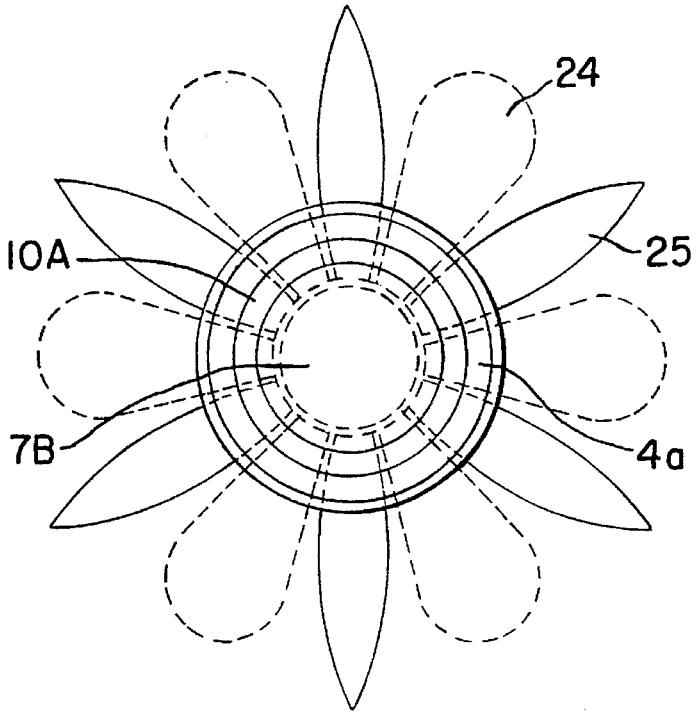
FIG. 22 is a front view of the gas burner shown in FIG. 21.

FIG. 21 is a cross sectional view of the low NOx gas burner and FIG. 22 is a side view of the same seen from the XXII direction of FIG. 21.

The gas burner 1 contains at center an air nozzle 20 for supply of combustion air and a gas nozzle 4*a* provided around the air nozzle 20. In action, a flow of primary combustion air 21 runs along the gas nozzle and is mixed with a fuel gas 2 from the same to a combustible mixture gas 23 which then moves radially of a flame stabilizer 10A.

Six separate flows of secondary combustion air 22 fed from a second combustion air passage through the center gas nozzle 4*a* come out in the opposite side of the flame stabilizer 10A to the flow of the mixture gas 23 and then, run radially of a flame stabilizer 7B.

The gas nozzle 4*a* has a plurality of gas blow apertures 8A therein at a location where the secondary combustion air 22 is not involved. At the location, the mixture gas 23 of the fuel gas 2 and the primary combustion air 21 is burnt producing gas-rich flames 24. Over the flame stabilizer 10A, the mixture gas 23 is mixed with the six secondary air flows 22 thus producing air-rich flames 25.

Example 12

Figure 23:
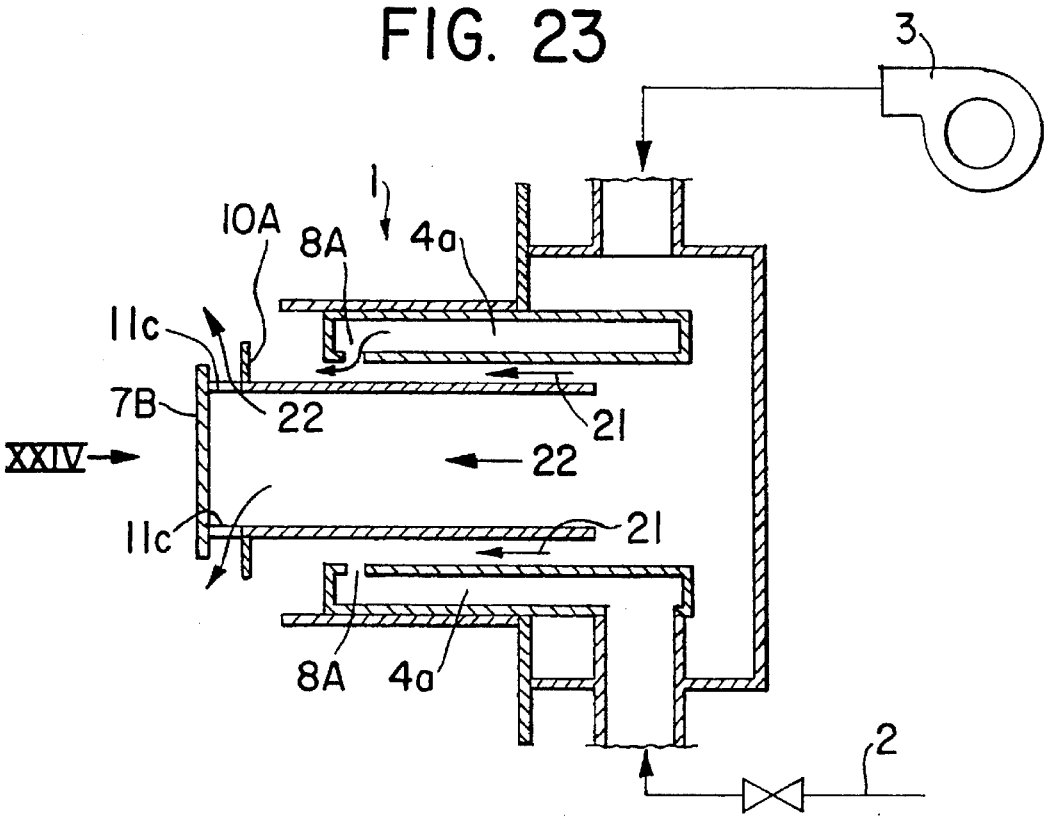
FIG. 23 is a cross sectional view showing a twelfth embodiment, a modification of the gas burner shown in FIG. 21.
Figure 24:
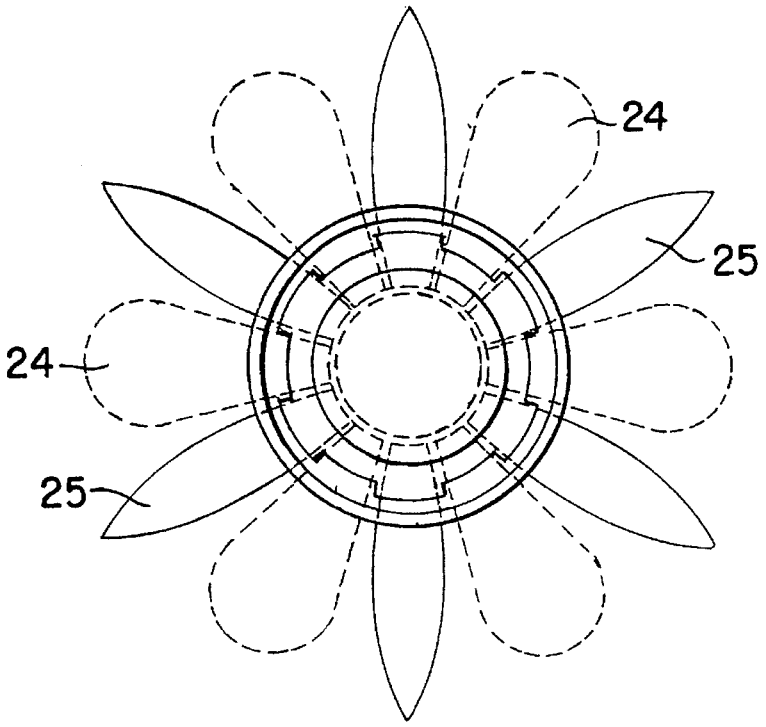
FIG. 24 is a front view of the modified gas burner shown in FIG. 23.

FIG. 23 is a cross sectional view of a modification of the low NOx gas burner of the eleventh embodiment and FIG. 24 is a side view of the same seen from the XXIV direction of FIG. 23.

The action of combustion is similar to that shown in FIGS. 21 and 22. The flame stabilizer 10A is arranged to have at the circumference end a corresponding number of notches to the separate secondary air flows 22. The notches are formed alternate with the outlets 11*c* of the secondary combustion air flows 22 so that the combustion flames become more distinguished from each other in the degree of concentration than those of the original low NOx gas burner shown in FIGS. 21 and 22.

Example 13

Figure 25:
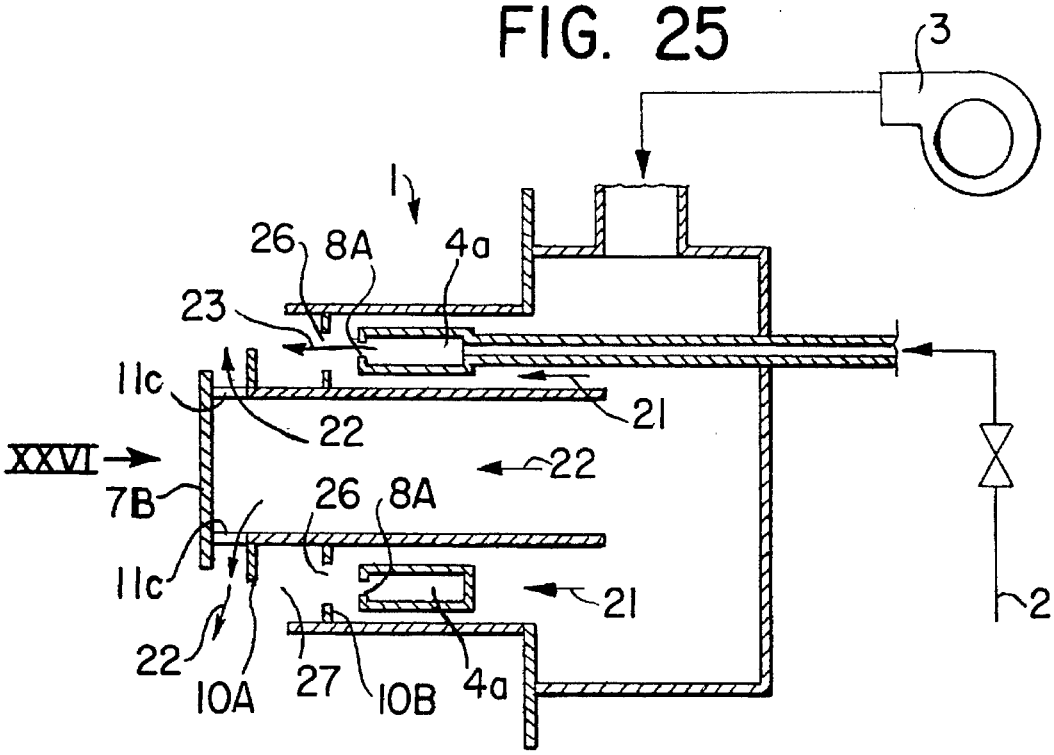
FIG. 25 is a cross sectional view showing a thirteenth embodiment, another modification of the gas burner shown in FIG. 21.
Figure 26:
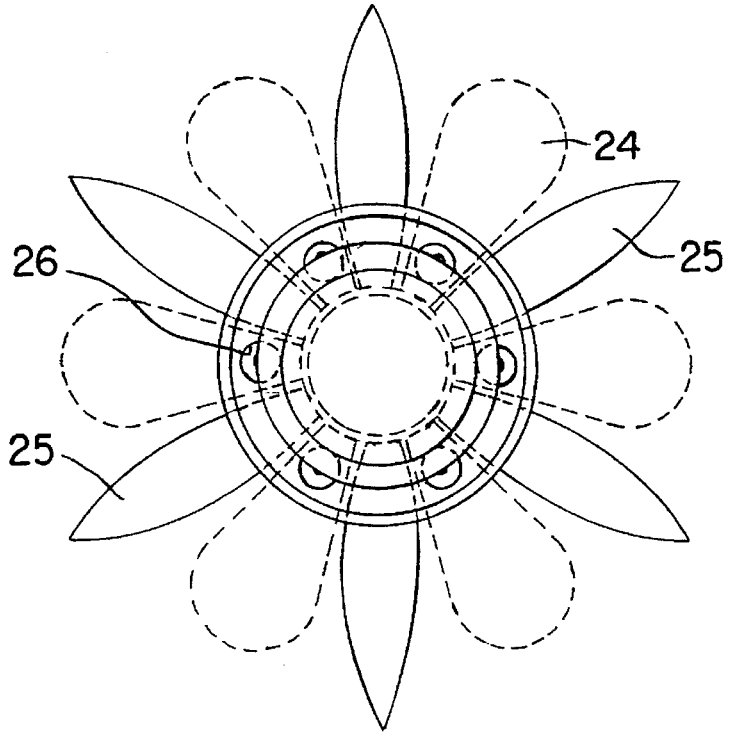
FIG. 26 is a front view of the modified gas burner shown in FIG. 25.

FIG. 25 is a cross sectional view of another modification of the low NOx gas burner of the eleventh embodiment and FIG. 26 is a side view of the same seen from the XXVI direction of FIG. 25.

As shown, an extra flame stabilizer 10B is provided behind the flame stabilizer 10A. The extra flame stabilizer 10B has a given number of openings 26 which constitute mixture gas passages 27. In action, separate flows of the second combustion air 22 which are identical in number to the flame stabilizers 10B run radially between the mixture gas passages 27. Accordingly, the lean and rich combustion flames will appear more definitely in size and strength.

A combustion test was conducted for examining the three different low NOx gas burners shown in FIGS. 21 to 26 (using a fuel gas flow of 50 $m^3$/hr and a gas pressure of 200 $mmH_2O$).

Figure 27:
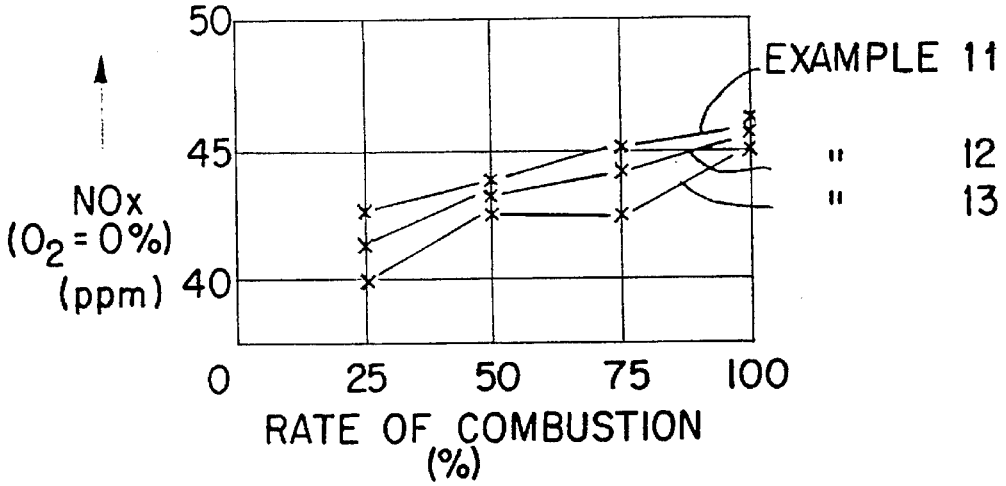
FIG. 27 is a diagram showing the relation between combustion rate and NOx concentration in exhaust gas.

FIG. 27 shows the resultant measurements of NOx concentration in the exhaust gas when the rate of combustion was varied from 25% to 100%. The concentration of NOx was found as low as 40 to 45 ppm at $O_2$=0%.

Figure 28:
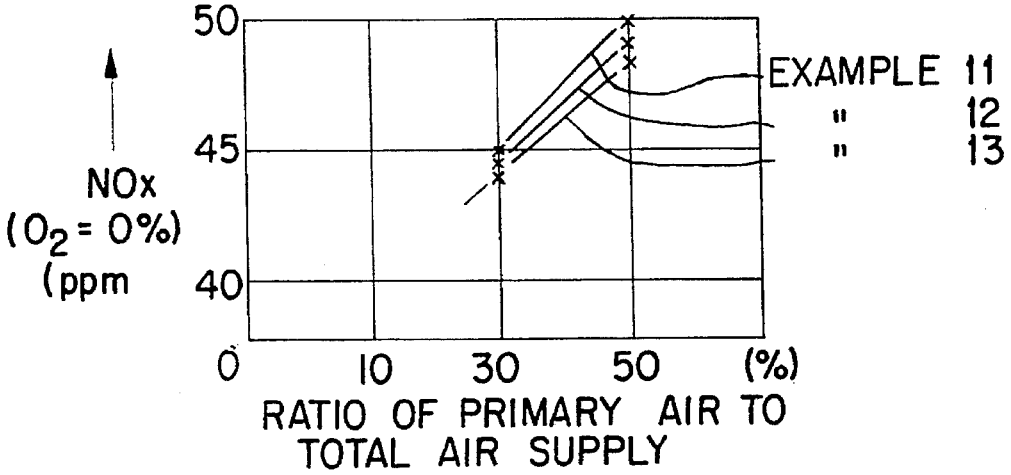
FIG. 28 is a diagram showing the relation between ratio of primary combustion air to total air supply and NOx concentration in exhaust gas.

FIG. 28 shows the measurements of NOx concentration in the exhaust gas when the primary combustion air was varied from 20% to 50% of the total supply of combustion air. The concentration of NOx was still as low as 45 to 50 ppm at $O_2$=0%.

Figure 29:
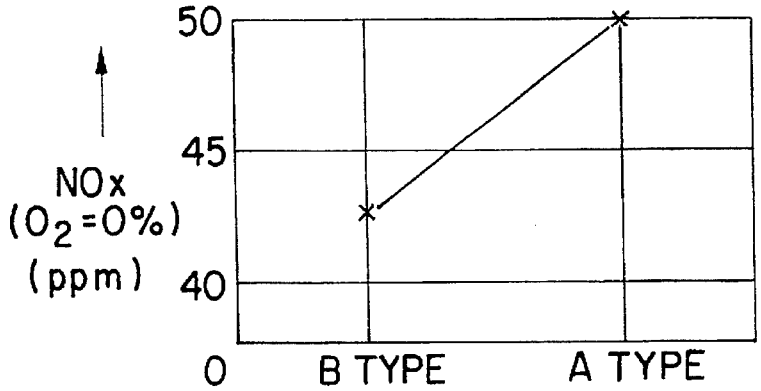
FIG. 29 is a diagram showing the NOx concentration in exhaust gas when the positional relation between gas blow apertures and secondary combustion air passages is different.

The generation of NOx was examined using two types: one (A type) has the gas blow apertures 8A of the gas nozzle 4*a* aligned circumferentially to match the secondary combustion air outlets 11*c* and the other (B type) has the same not to match. The result of NOx concentration in the exhaust gas is shown in FIG. 29. As apparent, the B type produced 43 ppm of NOx (at $O_2$=0%) while the A type produced 50 ppm.

Advantages of the present invention are as follows:

1. According to the present invention, the relation of the distance x between the first and second flame stabilizers with the diameter of each gas blow aperture of the gas nozzle is expressed by $y \leqq x \leqq 5y$. Also, the outer diameter of the first flame stabilizer is smaller than the inner diameter of the second flame stabilizer. Accordingly, the mixture gas runs along the second flame stabilizer radially of the gas nozzle and its combustion flames extend widely. This will encourage the cooling of the combustion flames and thus, maintain the combustion temperature at a lower degree. Hence, the generation of NOx will be minimized.

2. According to the present invention, the plural air supply apertures of the second flame stabilizer are provided adjacent to the gas blow apertures of the gas nozzle so that the fuel/air mixture gas flowing along the second flame stabilizer can be mixed with the secondary combustion air without affecting desired dispersion or separation of combustion flames which contributes to the reduction of NOx gas. Hence, the combustion at lower temperature will be ensured and the area of stable combustion will be increased.

3. According to the present invention, the second flame stabilizer has some of the second combustion air passages therein aligned circumferentially corresponding to the gas blow apertures of the gas nozzle and the other arranged not to match the gas blow apertures. In action, the fuel gas from the gas blow apertures is mixed with separate flows of the secondary combustion air thus producing a ring of lean and rich combustion flames. This action lower a combustion temperature and the generation of NOx will be minimized.

4. According to the present invention, the first flame stabilizer is arranged in front of the burner cone and spaced by a great distance from the second flame stabilizer. Also, the gas blow apertures of the gas nozzle are provided adjacent to the first flame stabilizer so that the combustion is carried out at two steps; a first step inside the burner cone and a second step outside the same. The two-step combustion will attenuate the generation of NOx. At the second step, the expansion of the combustion flames can be controlled. Hence, the gas burner when installed in a small-sized furnace will produce a less amount of uncombusted gas.

5. According to the present invention, the first flame stabilizer is arranged in front of the burner cone and spaced by a great distance from the second flame stabilizer. Also, the gas blow apertures of the gas nozzle are provided adjacent to the second flame stabilizer so that the combustion is carried out at two steps. The two-step combustion will attenuate the generation of NOx and also, control the expansion of the combustion flames. Hence, the gas burner when installed in a small-sized furnace will produce a less amount of uncombusted gas. Even if a slowly combustible fuel gas is used, it will be burnt through stable combustion action and its oscillating combustion will be averted.

6. A low NOx gas burner according to the present invention is designed for attenuating the generation of NOx, in which the mixture of fuel gas and combustion air is efficiently executed through lean and rich flame combustion, separate flame combustion, and exhaust gas recirculating combustion. Hence, the low NOx gas burner can produce a less amount of NOx when installed in a traditional recombustion type furnace which offers considerable disadvantages.

The low NOx gas burner of the present invention is simple in the construction, improved in the utilization, and low in the production cost. In fact, the improved low NOx gas burners can successfully be used in absorption type coolers, absorption type freezers, steam boilers, and hot water boilers and will further be applicable to a variety of industries.

7. According to the present invention, the first flame stabilizer is arranged of cone shape and the gas blow apertures of the gas nozzle are arranged to match the secondary combustion air passages of the second flame stabilizer so that its fuel gas blowing velocity becomes high. In action, the fuel/air mixture gas runs along the countertapered surface of the first flame stabilizer and comes to mix with the secondary combustion air from the secondary combustion air passages matching the gas blow apertures at optimum condition. Hence, the combustion will be completed before its flames reach the inner wall of a furnace even if the furnace is small in diameter, thus preventing the generation of uncombusted gas. Also, the fuel gas is fed at a high velocity and its combustion flames will thus be expanded properly to form a lean wall of fire. Hence, the combustion flames will remain short at a high temperature and the generation of NOx will be minimized.

8. According to the present invention, the second flame stabilizer is accompanied with support members for forward and backward movement along and inside the burner cone. Hence, the size and strength of combustion flames can be controlled by positioning the second flame stabilizer in accordance with the shape of a furnace in which the gas burner is installed. This will attenuate the generation of NOx and the gas burner will be improved in the utilization. Also, the gas nozzle comprises a first nozzle accompanied at front end with the first flame stabilizer and a second nozzle coupled to the rear end of the first nozzle so that the first nozzle can move forward and backward. Hence, the size and strength of combustion flames can be controlled by moving the first nozzle to position the first flame stabilizer in accordance with the shape of a furnace in which the gas burner is installed. In particular, the length of the flames can be limited by moving the first flame stabilizer towards the second flame stabilizer. This will attenuate the generation of NOx and the gas burner will be improved in the utilization.

9. A low NOx gas burner according to the present invention contains at center an air nozzle for supply of combustion air and a gas nozzle arranged around the air nozzle, in which the mixture of fuel gas and combustion air is efficiently executed through lean and rich flame combustion, separate flame combustion, and exhaust gas recirculating combustion so that the generation NOx is minimized. The low NOx gas burner of the present invention is simple in the construction, improved in the utilization, and low in the production cost. Hence, the improved low NOx gas burners can successfully be used in absorption type coolers, absorption type freezers, steam boilers, and hot-water boilers and will further be applicable to a variety of industries.

What is claimed is:

1. A gas burner comprising:

a gas nozzle having a first flame stabilizer mounted to a front end thereof, said nozzle having a plurality of gas blow apertures adjacent said first flame stabilizer for discharging fuel gas spaced at equal intervals around its outer surface, a plate forming a second flame stabilizer through which said gas nozzle front end extends, said second flame stabilizer having a plurality of secondary combustion air passages around its periphery for discharging secondary combustion air and a primary combustion air passage around said gas nozzle which extends through said second flame stabilizer for discharging primary combustion air, a burner housing having a front end, said second flame stabilizer plate being mounted within said housing front end; and a mixture of fuel gas from said nozzle gas blow apertures and primary combustion air from said second flame stabilizer primary air passage flowing radially outward of said nozzle between said first and second flame stabilizers as guided by said first flame stabilizer, which mixture mixes with a portion of the secondary combustion air supplied from the secondary combustion air passages of said second flame stabilizer, said second flame stabilizer being spaced from and located inward of said front end of the burner housing in which the secondary combustion air flows straight and said first flame stabilizer being located closer to said front end of said burner housing than said second flame stabilizer.

2. A gas burner according to claim 1 wherein the area of said primary combustion air passage of said second flame stabilizer through which fuel gas also passes is 20% to 50% of the total of the area of the primary/and secondary air passages through which combustion air passes.

3. A gas burner according to claim 2, wherein said second flame stabilizer further has a plurality of air supply apertures therein for receiving and having air flowing therethrough as third combustion air passages and whose entire opening is 5% to 15% of the total area of said primary, secondary and third passages through which combustion air passes.

4. A burner as in claim 1 wherein said first and second flame stabilizers are spaced apart in the range of from about 40 to 80 mm.

5. A low NOx gas burner comprising:

a secondary combustion air nozzle having two flame stabilizers mounted spaced apart at one end thereof and a plurality of secondary combustion air passages arranged circumferentially around the outer surface of said secondary air nozzle between the two flame stabilizers;

a gas nozzle mounted around said secondary combustion air nozzle with an annular space therebetween which serves as a primary combustion air passage, said gas nozzle having a plurality of gas blow apertures provided therein adjacent one end thereof to discharge fuel gas, the combustion air supplied to the burner being divided into a primary combustion air flow which passes through the primary combustion air passage and a secondary combustion air flow which passes through the secondary combustion air nozzle, the primary combustion air flow mixing with fuel gas supplied from the gas nozzle gas blow apertures and the secondary combustion air flow to discharge the mixture of the fuel gas and the primary combustion air radially of the flame stabilizer at locations closest to the burner and produce a ring of more gas-rich flames, the secondary combustion air flow from the secondary combustion air passage being directed in a radial direction by the flame stabilizer closest to the end of said secondary combustion air nozzle to produce a ring of more air-rich flames.

6. A low NOx gas burner according to claim 5, wherein said gas blow apertures of said gas nozzle are equal in number to the number of secondary combustion air passages, and are arranged offset circumferentially from said secondary combustion air passages.

7. A low NOx gas burner according to claim 5, wherein the amount of the secondary combustion air is 50% to 80% of the total air supply.

8. A burner as in claim 5 wherein said secondary combustion air passages comprise 4 to 8 apertures arranged circumferentially at equal intervals around the outer surface of said secondary combustion air nozzle.

9. A gas burner comprising:

a burner housing;

a nozzle through which gas flows from a first part within said housing to a nozzle second part having an end directed away from said housing;

a first flame stabilizer on said end of said nozzle second part;

a plate forming a second flame stabilizer at one end of said burner housing, said nozzle second part extending through said second flame stabilizer and having a plurality of gas blow apertures spaced around its outer surface and adjacent said first flame stabilizer;

said second flame stabilizer having a plurality of secondary combustion air passages arranged at equal intervals around its periphery and a primary air passage around said nozzle second part which extends through said second flame stabilizer; and the distance x between the opposing surface of the first and second flame stabilizers being $$y \leqq x \leqq 5y$$

where y is the diameter of a said gas blow aperture of said nozzle second part.

10. A gas burner comprising:

a burner housing;

a nozzle through which gas flows from a part within said housing to a nozzle second part having an end directed away from said housing;

a first flame stabilizer on said end of said nozzle second part;

a plate forming a second flame stabilizer at one end of said burner housing, said nozzle second part extending through said second flame stabilizer plate and having a plurality of gas blow apertures spaced around its outer surface at equal intervals and adjacent said first flame stabilizer;

said second flame stabilizer having a plurality of secondary combustion air passages arranged at equal intervals around its periphery and a primary air passage around said nozzle second part which extends through said second flame stabilizer; and said second flame stabilizer located adjacent to said nozzle gas blow apertures and having a plurality of air supply apertures therein which are radially of and aligned with said nozzle gas blow apertures.

11. A gas burner comprising:

a burner housing;

a nozzle through which gas flows from a part within said housing to a nozzle second part having an end directed away from said housing;

a first flame stabilizer on said end of said gas nozzle second part;

a plate forming a second flame stabilizer at one end of said burner housing, said nozzle second part extending through said second flame stabilizer and having a plurality of gas blow apertures spaced around its outer surface at equal intervals adjacent said first flame stabilizer;

said second flame stabilizer having a plurality of secondary combustion air passages spaced at equal intervals around its periphery and a primary air passage around said nozzle second part which extends through said second flame stabilizer; and said gas blow apertures being aligned radially with said second flame stabilizer secondary combustion air passages, and a group of extra secondary combustion air passages provided in said secondary flame stabilizer radially of said nozzle second part and inwardly of the periphery of said second flame stabilizer between any two of said second flame stabilizer secondary combustion air passages which are aligned with said gas blow apertures.

12. A gas burner comprising:

a burner housing;

a nozzle through which gas flows from a part within said housing to a nozzle second part having an end directed away from said burner housing;

a first flame stabilizer on said end of said nozzle second part;

a plate forming a second flame stabilizer at one end of said burner housing, said nozzle second part extending through said second flame stabilizer and having a plurality of gas blow apertures spaced around its outer surface at equal intervals adjacent said first flame stabilizer;

said second flame stabilizer having a plurality of secondary combustion air passages spaced at equal intervals around its periphery and a primary air passage around said nozzle second part which extends through said second flame stabilizer; and said second flame stabilizer spaced inwardly of said one end of said burner housing and said first flame stabilizer located outward of and spaced from said burner housing one end by a greater distance than said second flame stabilizer, and said nozzle gas blow apertures being located adjacent said first flame stabilizer.

13. A gas burner comprising:

a burner housing;

a nozzle through which gas flows from a part within said housing to a nozzle second part having an end directed away from said housing;

a first flame stabilizer on said end of said nozzle second part;

a plate forming a second flame stabilizer at one end of said burner housing, said nozzle second part extending through said second flame stabilizer and having a plurality of gas blow apertures spaced around its outer surface at equal intervals;

said second flame stabilizer having a plurality of secondary combustion air passages spaced at equal intervals around its periphery and a primary air passage around said nozzle second part which extends through said second flame stabilizer; and said second flame stabilizer spaced inwardly of said one end of said burner housing and said first flame stabilizer located outward of and spaced from said burner housing one end by a greater distance than said second flame stabilizer, and said nozzle gas blow apertures being located adjacent said second flame stabilizer.

14. A gas burner comprising:

a burner housing;

a nozzle through which gas flows from a part within said housing to a nozzle second part;

a first flame stabilizer on the end of said gas nozzle second part;

a plate forming a second flame stabilizer at one end of said burner housing, said gas nozzle second part extending through said second flame stabilizer and having a plurality of gas blow apertures spaced around its outer surface at equal intervals adjacent said first flame stabilizer;

said second flame stabilizer having a plurality of secondary combustion air passages arranged at equal intervals around its periphery and a primary air passage around said nozzle; and said first flame stabilizer being of conical shape with the base of the cone facing away from said second flame stabilizer and said second flame stabilizer secondary air passages extending radially of and aligned with said nozzle gas blow apertures.

* * * * *